US005553595A

United States Patent [19]

Nishioka et al.

[11] Patent Number: 5,553,595

[45] Date of Patent: Sep. 10, 1996

[54] FUEL SYSTEM WITH FUEL VAPOR ESTIMATING FEATURE

[75] Inventors: Futoshi Nishioka; Tetsushi Hosokai, both of Hiroshima; Kazuo Tanaka, Okayama, all of Japan

[73] Assignee: Mazda Motor Corporation, Hiroshima-ken, Japan

[21] Appl. No.: 413,703

[22] Filed: Mar. 30, 1995

[30] Foreign Application Priority Data

Mar. 30, 1994 [JP] Japan ..... 6-061549

[51] Int. Cl.[6] ..... F02M 51/00

[52] U.S. Cl. ..... 123/698

[58] Field of Search ..... 123/698, 699, 123/674, 675, 684, 489, 479

[56] References Cited

U.S. PATENT DOCUMENTS

| | | | |
|---|---|---|---|
| 5,143,040 | 9/1992 | Okawa et al. | 123/698 |
| 5,257,613 | 11/1993 | Monda et al. | 123/674 |
| 5,361,745 | 11/1994 | Suzuki et al. | 123/698 |
| 5,404,862 | 4/1995 | Ohta et al. | 123/698 |
| 5,423,307 | 6/1995 | Okawa et al. | 123/698 |
| 5,474,049 | 12/1995 | Nagaishi et al. | 123/520 |

FOREIGN PATENT DOCUMENTS 2-245441 10/1990 Japan .

*Primary Examiner*—Raymond A. Nelli
*Attorney, Agent, or Firm*—Keck, Mahin & Cate

[57] ABSTRACT

A fuel system for feedback controlling an air-to-fuel ratio to maintain an ideally combustible air-fuel mixture includes an evaporation control device, which stores fuel vapors from a fuel tank and purges the fuel vapors stored therein into an intake system, and a fuel vapor evaluation system, which calculates an average of the feedback control parameters, estimates an amount of the fuel vapors stored in the evaporation control means based on the average feedback control parameter, calculates an amount of the fuel vapors replenished into the intake system based on the estimated amount of fuel vapors, and calculates a difference between an amount of fuel necessary for an ideally combustible air-fuel mixture and the replenished amount of fuel vapors. Fuel in an amount equal to the difference is delivered into the intake system.

35 Claims, 11 Drawing Sheets

START
S101
Fidc = 1 ?
NO
YES
S102
Fafb = 1 ?
NO
YES
S103
Cit > α ?
NO
YES
S104
Cet < β ?
NO
YES
S108
Fal = 1
S105
A/F LEARNING CONTROL
S107
Cet = Cet + 1
S109
Cit = 0
Cet = 0
S106
Cit = Cit + 1
S110
Fpg = 1 ?
NO
YES
S111
Fafb = 1 ?
NO
YES
S112
Qar < γ ?
NO
YES
S113
Fal = 1 ?
NO
YES
S114
ESTIMATE Tva
RETURN

FUEL SYSTEM WITH FUEL VAPOR ESTIMATING FEATURE

BACKGROUND OF THE INVENTION

1. Field of the Invention

The present invention relates to a fuel control system for vehicle engines, and, more particularly, to a fuel control system including fuel vapor control system which estimates, or otherwise measures, an amount of fuel vapors stored in a storage canister and calculates an amount of fuel vapors purged into an intake system based on the estimated or measured amount of fuel vapors.

2. Description of Related Art

Typically, fuel injection systems for automobiles cooperate with fuel control systems which determines a proper air-to-fuel ratio of an air-fuel mixture based on an amount of intake air introduced into an intake system. Based on the amount of intake air, an injector is pulsed at a basic pulse width. However, there is a limit in the accuracy of fuel mixture setting control. Fuel from an injector is not always immediately delivered entirely into an engine. Further, the injector valve suffers changes in injection characteristics due to aging. For these reasons, if the amount of fuel delivered by a given injector is determined based on the amount of intake air only, it is hard to deliver an air-to-fuel ration agreeable with the target air-to-fuel ration with a high accuracy. For more accurate air-to-fuel control, a closed-loop or feedback control system has an oxygen sensor for monitoring the content of oxygen in the exhaust to verify the accuracy of the mixture setting. the oxygen content is off, the system corrects itself to bring the oxygen back to proper levels. The system tries to maintain a target air-to-fuel ratio which refers to an ideally combustible air-fuel mixture. Whenever the oxygen content is off, the system corrects itself to bring the oxygen back to proper levels. The system tries to maintain a target air-to-fuel ratio which refers to an ideally combustible air-fuel mixture. If the feedback control parameter remains a fixed level, an air-to-fuel ratio is controlled in an open-loop.

Automobiles are also provided with evaporation control systems. Such an evaporation control system as emission control systems designed to prevent gasoline vapors escaping into atmosphere from a fuel tank. A vapor storage canister is filled with highly activated charcoal particles or granules for absorbing and storing fuel vapors when the fuel vapors touch them. The evaporation control system includes a purge device for delivering properly fuel vapors into the intake system. In such an evaporation. system, the vapor storage canister is connected to the intake system through a purge line with a purge valve. When the purge valve opens, fuel vapors are introduced into the intake system from the vapor storage canister. If, while an air-to-fuel ratio is controlled in an open-loop, vapor purging takes place, the air-to-fuel ratio shifts greatly from the target air-to-fuel ratio. Accordingly, vapor purging is ordinarily effected during feedback control. In such a case where vapor purging is effected during feedback control, purged vapors are regarded as a disturbance in air-to-fuel ratio control. If the vapor storage canister stores fuel vapors, this disturbance is compensated by changing a feedback control parameter to a lean side from a neutral level in the feedback air-to-fuel ratio control. While, if the amount of fuel vapors delivered into the intake system is constant and the engine operates under ordinary driving conditions, the compensation of a disturbance such as due to purging is exact, nevertheless, if there occurs a sudden change in the among of purged fuel vapors, for example if the purge valve is opened from a shut down state or closed from an opened state, or otherwise there is a sudden pressure drop between before and after the purge valve, or the engine is in transient states of operation such as acceleration and deceleration, the compensation of disturbances such as due to purging is insufficient due to a delay of detection of an air-to-fuel ratio or a delay of response in the feedback air-to-fuel ratio control, leading to a great shift of air-to-fuel ratio from the target air-to-fuel ratio. Such a shift of air-to-fuel ratio is considered to result from some reasons.

If the purge valve is opened from a shut down state during the feedback air-to-fuel ratio control, an air-to-fuel ratio is changed so as to enrich a fuel mixture. This air-to-fuel ratio is monitored by a linear oxygen ($O_2$) sensor in the exhaust line and controlled to change toward a lean side so as to become a proper level. when the purging is one of causes of an enriched air-to-fuel ratio, there doe not arise any correction of the enriched air-to-fuel ratio until a change in air-to-fuel ratio is actually monitored by the oxygen sensor or a correction of the enriched air-to-fuel ratio takes place with a delay of time. Further, when the engine is in a transient state of operation such as acceleration during purging, there occurs a sudden change in the pressure difference between before and after the purging valve. As a result, the amount of fuel vapors itself or a proportion of the amount of fuel vapors relative to the total amount of fuel, introduced into the engine for one intake stroke, drops suddenly, resulting in a lean air-to-fuel ratio. On the other hand, on deceleration during purging, an air-to-fuel ratio is enriched. Neither the lean air-to-fuel ratio nor the rich air-to-fuel ratio is corrected until it is monitored by the oxygen sensor. Accordingly, fuel is consumed more than necessary and hydrocarbon emission into atmosphere increases in the incident where the rich air-to-fuel ratio remains for a while or is corrected with a delay of time. On the other hand, in the incident where the air-to-fuel ratio remains lean, the engine can not provide sufficient output.

If an increasing change and a decreasing change in the amount of purged fuel vapors alternately takes place at frequent intervals, or if acceleration and deceleration are repeated at frequent intervals during purging, the air-to-fuel ratio feedback control takes effect with a delay of time and consequently, causes hunting, so as to turn out unstable. In the case where purged fuel vapors are treated as disturbances against the air-to-fuel ratio feedback control, if a large among of fuel vapors is purged, the feedback control parameter clings to a limit on the lean side as a result that the air-to-fuel ratio control system tries to counteract the disturbances, leading to failure in meeting disturbances caused for other reasons.

It can be thought to detect the amount of purged fuel vapors and use the purged fuel vapors as a part of a substantially necessary amount of fuel, so as thereby to exclude the purged fuel vapors acting as disturbances against the air-to-fuel ratio feedback control. However, there has not been any practical approaches to detect directly the amount of purged fuel vapor. Accordingly, approaches have been made of indirect detection of the amount of purged vapors.

One such approach is that described in Japanese Laid-Open Patent No. 2-245441. The approach used was to estimate the purged amount of fuel vapors based on a difference of a feedback control parameter from a neutral level. In this prior art fuel system, a purged amount of fuel vapors per one revolution of engine is calculated as the estimated pursed amount of fuel vapors, the basic amount of fuel delivered per one revolution of engine by a given injector is reduced by the purged amount of fuel vapors.

As has been proved in the art, the purged amount of fuel vapors changes at short intervals with changes in engine driving conditions including, for instance, the amount of intake air, the pressure of intake air and the speed of engine. Together, because, as was previously described, the calculation of a feedback control parameter is based on an air-to-fuel ratio monitored by an oxygen sensor and consequently, accompanied by a delay of time, if the engine driving condition, i.e. the actual purged amount of fuel vapors, changes at short intervals, the estimation of the purged amount of fuel vapor is made with only a low accuracy, leading to a great shift of air-to-fuel ratio from the target air-to-fuel ratio.

From the above discussions, shifts in air-to-fuel ratio from a target air-to-fuel ratio can be avoided during purging if the purged amount of fuel vapors is detected with a high accuracy. As a result of much attention having been given to various approaches relating to high accuracy detection of the purged amount of fuel vapors, it has been proved that changes in the amount of fuel vapors stored in a vapor storage canister due to the passage of time are notably lenient as compared to changes in engine driving conditions and are insignificant in a period of time equivalent to the delay of response of the air-to-fuel feedback control to monitored air-to-fuel ratios or in one cycle of the air-to-fuel feedback control. This teaching alludes to a technique for detecting the purged amount of fuel vapors with a high accuracy without accompanying a delay of time due to the detection of air-to-fuel ratio.

SUMMARY OF THE INVENTION

It is therefore an object of the present invention to provide a fuel control system in which the amount of fuel vapors in a vapor storage canister is estimated with a high accuracy.

It is another object of the present invention is to provide a fuel system in which the pursed amount of fuel vapors or the amount of fuel vapor entering into an intake system is calculated based on an estimated amount of fuel vapors in a vapor storage canister.

It is also an object of the present invention to provide a fuel system in which purging takes place based on the purged amount of fuel vapors or the amount of fuel vapor entering into an intake system without causing shifts in an air-to-fuel ratio from a target air-to-fuel ratio.

The present invention provides a fuel system which feedback controls an air-to-fuel ratio according to a feedback control parameter determined based on a deviation of an effective air-to-fuel ratio detected from a target air-to-fuel ratio so as to maintain an ideally combustible air-fuel mixture. The fuel system comprises an evaporation control means for storing fuel vapors from a fuel tank and purging the fuel vapors stored therein into an intake system and a fuel vapor evaluation means for calculating an average of the feedback control parameters, estimating an amount of the fuel vapors stored in the evaporation control means based on the average feedback control parameter, calculating an amount of the fuel vapors replenished into the intake system based on the estimated amount of fuel vapors, and calculating a difference between an amount of fuel necessary for an ideally combustible air-fuel mixture and the replenished amount of fuel vapors, whereby causing the fuel system to deliver fuel of an amount equal to the difference into the intake system. The fuel vapor evaluation means may increasingly or decreasingly alter the estimated amount of fuel vapors in a preceding control cycle according to a difference of the average feedback control parameter from a predetermined neutral value.

Specifically, the fuel vapor evaluation means may suspend the estimation of an amount of fuel vapors stored in the evaporation control means when the feedback control parameter is less correlative to an amount of said fuel vapors stored in said evaporation control means, such as when the evaporation control means suspends purging the fuel vapors stored into the intake system, when the amount of air introduced into the intake system is less than a predetermined level, when the pressure of air introduced into said intake system is lower than a predetermined level, and when the air-to-fuel ratio feedback control is suspended.

The fuel vapor evaluation means gives a decision of completion of estimation of the amount of fuel vapors when an absolute value of the average feedback control parameter is less than a predetermined level. If the estimation of the amount of fuel vapors is continuously suspended for more than a predetermined period of time, the fuel vapor evaluation means may withdraw the decision of completion of the estimation of fuel vapors.

BRIEF DESCRIPTION OF THE DRAWINGS

The above and other objects and features of the present invention will be clearly understood from the following description with respect to a preferred embodiment thereof when considered in conjunction with the accompanying drawings, in which.

DETAILED DESCRIPTION OF THE PREFERRED EMBODIMENT

Figure 1:
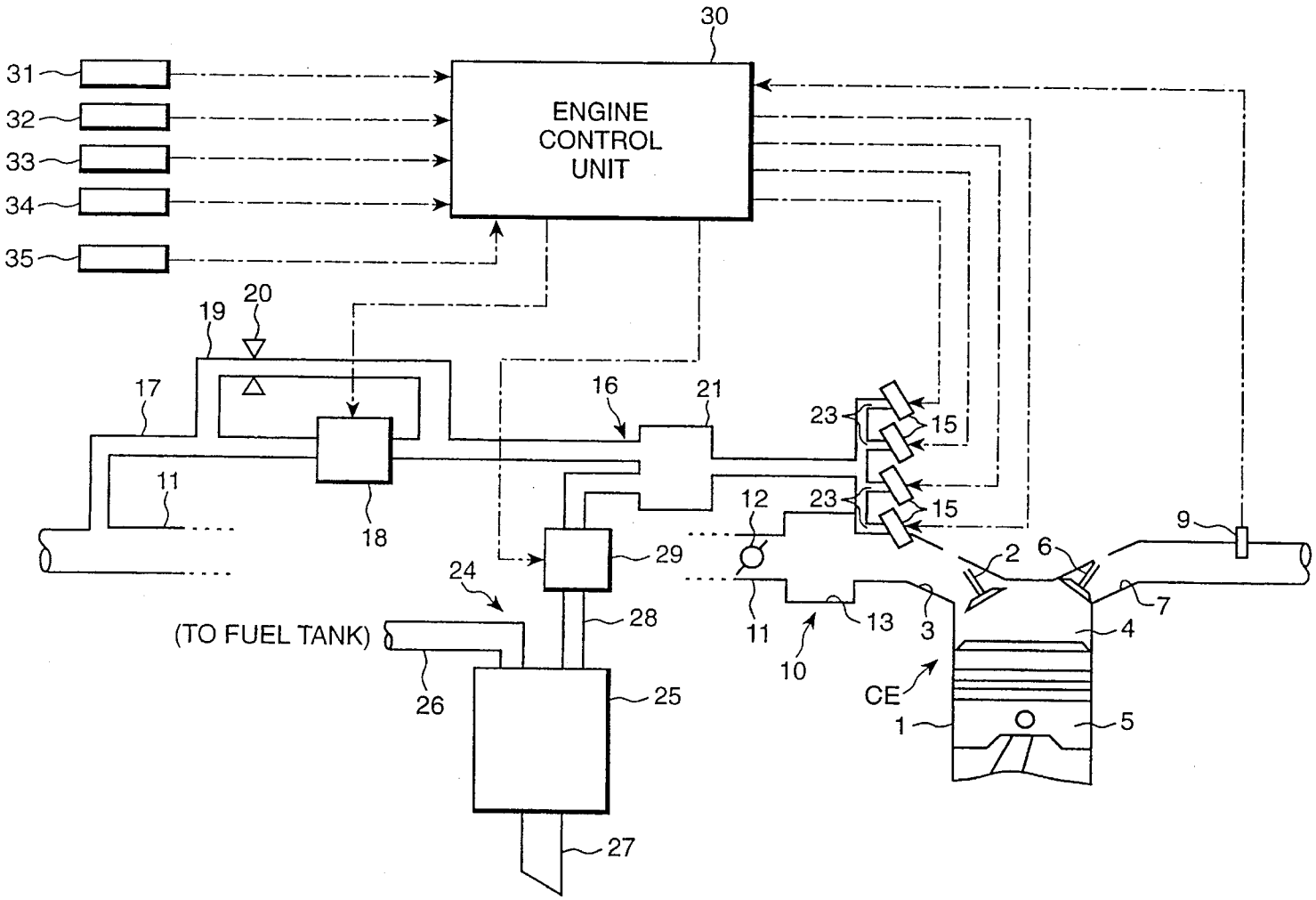
FIG. 1 is a block diagram illustrating a fuel control system in accordance with an embodiment of the present invention.

Referring now to the drawings in detail, and in particular, to FIG. 1, an internal combustion engine CE, such as a fuel injection type of four cylinder gasoline engine, cooperating with an engine control system in accordance with a preferred embodiment of the present invention is schematically shown. The engine CE has four cylinders 1 (only one of which is shown). Each cylinder 1 is provided with an intake port 3 and an exhaust port 7 which open into an combustion chamber 4 and are opened and closed at a predetermined timing by an intake valve 2 and an exhaust valve 6, respectively. A fuel mixture, introduced into the combustion chamber 4 when the intake port 3 is opened by the intake valve 2, is compressed by a piston 5. As the piston 5 reaches the top of the compression stroke, the fuel mixture is broken into tiny articles and heated up. When ignited, it is exploded with great force and, in turn, forces the piston down through the cylinder 1. When the piston reaches the bottom of the firing stroke the exhaust valve 6 opens the exhaust port 7. A spinning crankshaft forces the piston 5 up through the cylinder 1 blowing burned gases out of the cylinder 1 into an exhaust line 8.

The engine CE is provided an intake system 10 for introducing air into the combustion chamber 4 of engine CE therethrough. The intake system 10 includes an intake line 11 in communication, at one end, namely an upstream end, with the atmosphere and, at another end, namely a downstream end, with the intake port 3. The intake line 11 is provided with a throttle valve 12 in cooperation with an accelerator pedal (not shown) for regulating the amount of air introduced into the engine CE. Further, the intake line 11 is formed with a surge tank 13, located downstream from the throttle valve 12, for providing a stable air flow. This surge tank 13 is connected to the cylinders 1 by means of individual intake lines 14 (only one of which is shown) in communication with the intake ports 3, respectively.

An exhaust sensor, such as a linear oxygen ($O_2$) sensor 9, is provided in the exhaust line 8 so as to monitor the oxygen ($O_2$) content of the exhaust. A fuel system determines a proper air-to-fuel ratio and then constantly monitors its exhaust to verify the accuracy of a mixture setting. Whenever the oxygen ($O_2$) sensor 9 determines the oxygen content is off, the system corrects itself to bring the oxygen back to proper levels and, in such a way, tries to maintain an ideally combustible air-to-fuel ratio. In this instance, from the fact that an air-to-fuel ratio is determined unconditionally correspondingly to the oxygen content, it is referred to as an effective air-to-fuel ration for convenience in this specification.

A fuel system includes fuel injection means, such as fuel injection valves 15, each of which is provided near the intake port 3 in each individual intake line 14. This fuel injection valve 15 is directed so as to deliver fuel toward the combustion chamber 4. The fuel injection valve 15 is pulsed to open by energizing a solenoid. Pulse width, which is a measurement how long the fuel injection valve is kept open and upon which the amount of fuel delivered by the fuel injection valve depends, is controlled by an electronic engine control unit 30, such as comprised by a microcomputer, that constantly monitors engine speed, load, throttle position or opening, exhaust temperature, etc. Based on all these incoming signals the control unit is constantly adjusting pulse width so as to deliver a correct air-to-fuel ratio for any given engine demand. The fuel system further has an assist air delivery means or system 16 which delivers air to each fuel injection valve so as to accelerate vaporization of fuel. The assist air delivery system 16 has an air line 17 in communication at its upstream end with the intake line 11 of intake system 10 upstream from the throttle valve 12. This air intake line 12 is provided in order from the upstream side with a regulator valve 18 and a mixing chamber 21. This regulator valve 18 is of a solenoid type and controlled to open and close by the engine control unit 30. The air intake line 12 is further provided with a bypass line 19 with so as to allow air to flow bypassing the regulator valve 20 when the regulator valve 20 closes. The orifice 20 causes a pressure loss (pressure drop) of air flowing through the bypass passage 19, regulating the flow rate of air. After the mixing chamber 21, the air line 17 branches off into four individual air lines 23 for connecting the mixing chamber 21 to the fuel injector valves 15, respectively, so as to deliver assisting air.

The engine CE is accompanied by an evaporation control system 24, which is also called evaporative emission control system, for preventing the release of either liquid gasoline or gasoline vapor into the atmosphere. The evaporation control system 24 includes a vapor storage canister 25 filled with highly activated charcoal particles or granules for absorbing and storing fuel vapors when the fuel vapors touch them. The vapor storage canister 25 per se may take any type well known to those skilled in the art. This vapor storage canister 25 is provided with a fuel tank vent line 26 through which any vapors in a fuel tank (not shown) travel to the vapor storage canister 28, an air vent line 27 open into the atmosphere, and a purge air line 28 connected to the mixing chamber 21. The purge air line 28 is provided with a duty solenoid operated canister purge valve 29 by which it is opened and closed. Opening of the canister purge valve 29 is controlled by imparting a duty signal to the canister purge valve 29 from the engine control unit 30. Duty is a rate of how large the canister purge valve 29 is opened—the higher the duty, the larger the opening. Specifically, the canister purge valve 29 opens fully at a duty of 100% and closes fully at a rate of 0%.

When the canister purse valve 29 is closed fully at a duty Dsr of 0%, vapors from the fuel tank enter the vapor storage canister 25 through the fuel tank vent line 26 and move down and through the charcoal, so that fuel vapors are separated and absorbed from air by the charcoal. The air is drawn out of the vapor storage canister 25 through the air vent line 27. On the other hand, when the canister purge valve 29 is opened at a duty Dsr, fresh air is forced, due to vacuum or a negative pressure under the throttle valve, into the vapor storage canister 25 through the air vent line 27. As the air passes over the charcoal, it picks up the stored or trapped fuel vapors and draws them, through the purge air line 28, into the mixing chamber 21 where they are mixed with air entering it through the intake line 11. Thus, as the engine CE continues to run, the vapor storage canister 25 is purged or cleaned of fuel vapors. In is of course that a flow rate of purge air depends upon an opening in size of the canister purge valve 29.

In this instance, because a fuel vapor delivery line from the vapor storage canister 25 to the intake port 3 has a sizable length of distance, in other words, a sizable volume, the fuel vapors are delivered to the combustion chamber 4 after a delay depending upon volume and configuration of the delivery line. Consequently, a flow rare at which fuel vapors are drawn out of the vapor storage canister 25 (which is hereafter referred to as a vapor draw rate) at a time is ordinarily inconsistent with a flow rate at which they enter the intake port 3 (which is hereafter referred to as a vapor replenishment rate) at the time, excluding the engine CE continuously runs under constant conditions. For this reason, the following description will be given separately to these vapor draw rate and vapor replenishment rate. However, because, if the fuel vapor delivery line is small in volume, such a delay is sufficiently small and can be disregarded, both rates are discussed as a vapor draw rate without any distinction.

The engine control unit 30 performs overall control of the engine CE, including various fuel vapor control such as an estimation of the amount of vapors stored or trapped in the vapor storage canister 25 and calculations of a vapor drawn rate and a vapor replenishment rate. General control of engine is well known to those skilled in the art, so that the following description is directed only to such fuel vapor control in connection with air-to-fuel ratio control.

If the engine CE has no assist air delivery system 16, the purge air line 28 may be connected at its downstream end to each individual intake line 14.

Figure 2:
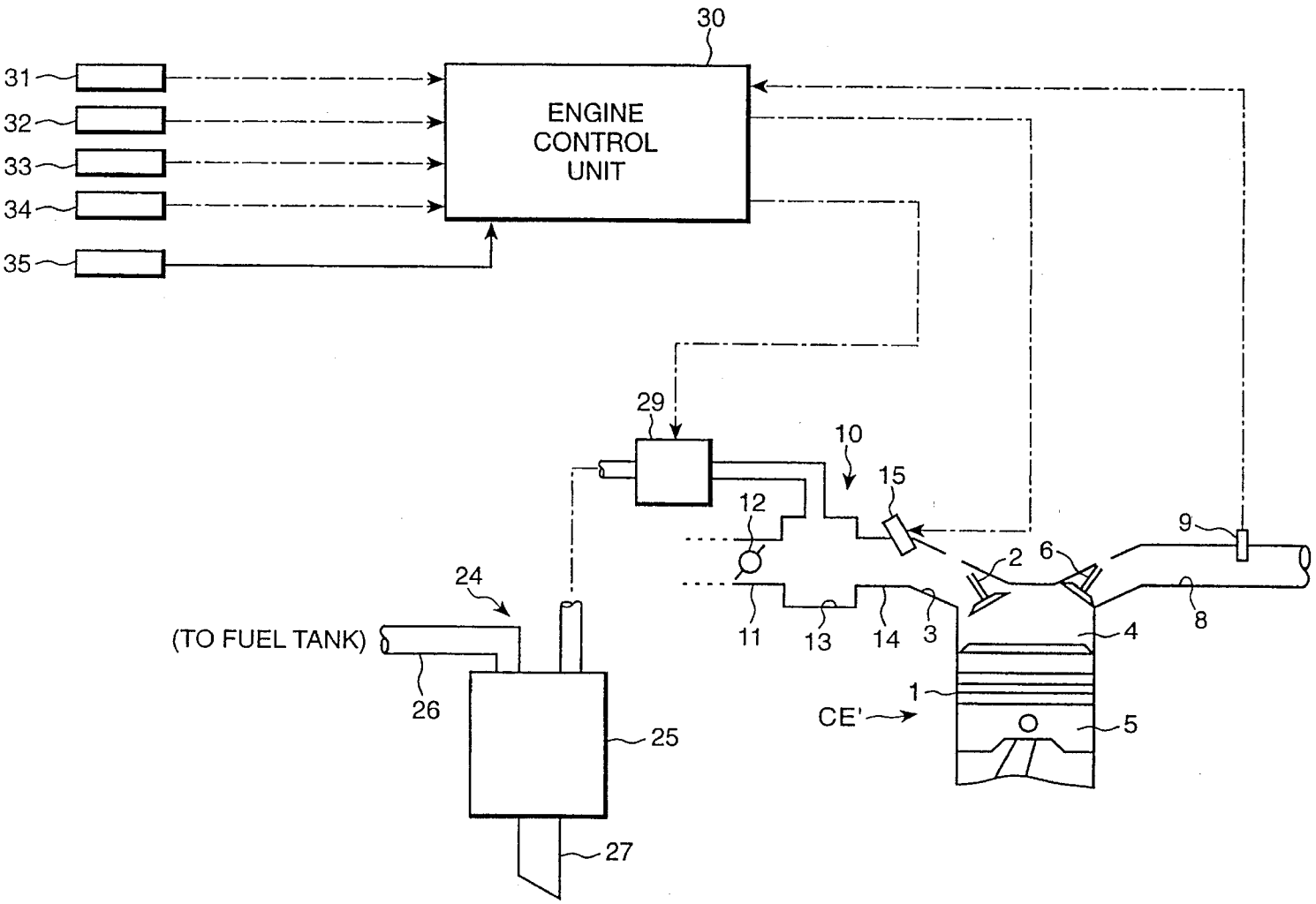
FIG. 2 is a block diagram of another version of the fuel control system in accordance with the present invention.

Further, as shown in FIG. 2, an engine CE' which has no assist air delivery system 16 may be provider with a purge air line 28 connected at its downstream to a surge tank 13 so as to guide fuel vapors from a vapor storage canister 25 directly into an intake system 10.

Figure 3:
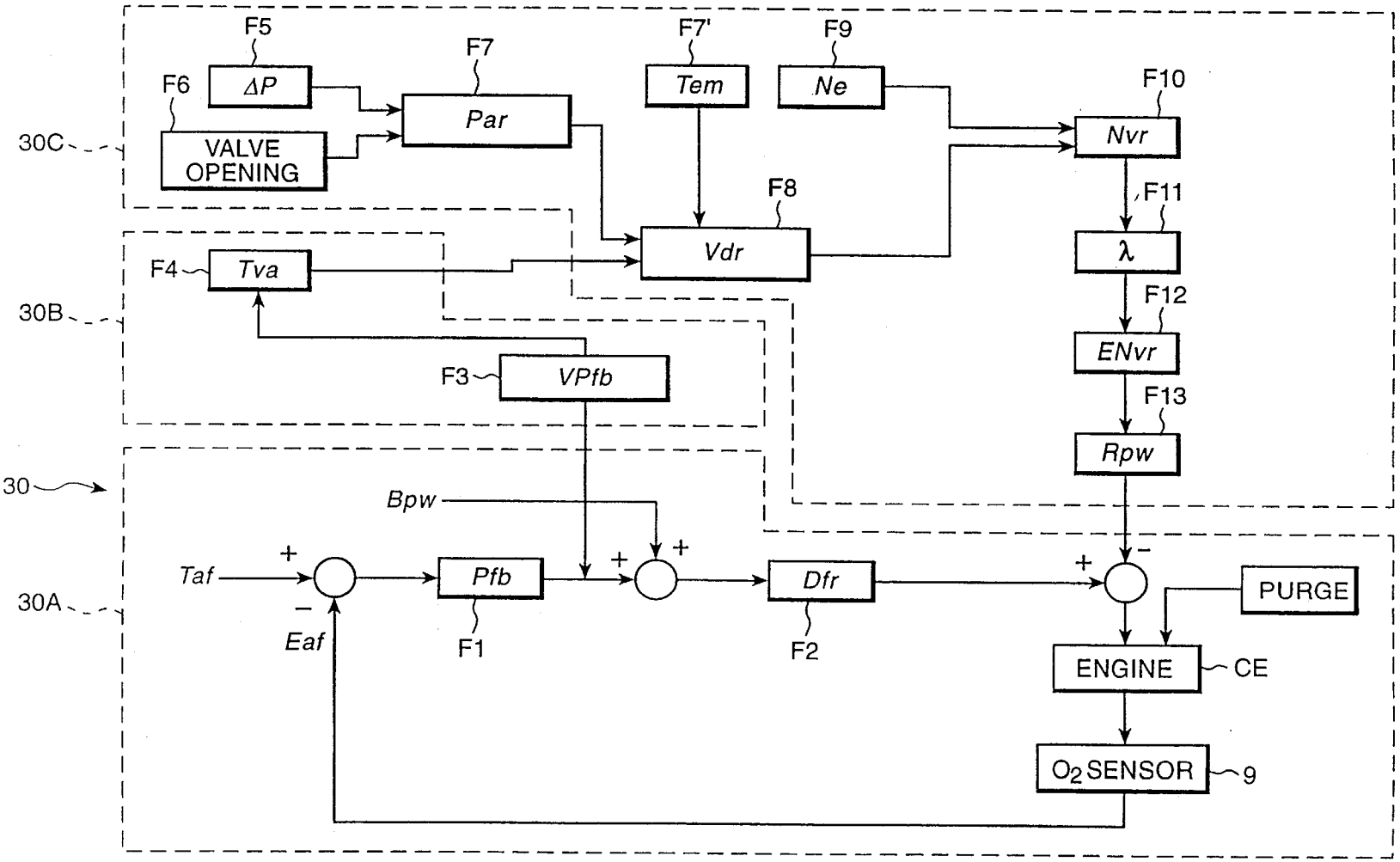
FIG. 3 is a functional block diagram illustrating a control unit of the fuel control unit.

Referring to FIG. 3, which is a schematic block diagram illustrating basic functional organization of the engine control unit 30, there are separated into three functional blocks, namely an engine control section 30A for performing air-to-fuel control and canister purge control, a vapor amount estimation section 30B for estimating the amount of stored or trapped vapors Tva, and an vapor rate calculation section 30C for performing calculations of a quantitative vapor drawn rate Vdr and a vapor replenishment rate Vrr based on the estimated value of stored or trapped vapor amount Tva. For these controls, the engine control unit 30 receives various signals from the oxygen ($O_2$) sensor 9, a throttle opening sensor 31, an air flow meter or sensor 32, an engine speed sensor 33 and an idle sensor 34. All of these sensors 9 and 31–33 may take any types well known in the art.

The engine control section 30A controls an air-to-fuel ratio in either feedback control, or otherwise feed-forward or open loop control, so as to maintain a target or ideally combustible air-to-fuel ratio Taf and, in addition, performs, if necessary, purging the vapor storage canister 25. Specifically, an effective air-to-fuel ratio Eaf is controlled in the feedback control based on its deviation from the target air-to-fuel ratio Taf (which is hereafter referred to as an air-to-fuel ratio deviation Daf) when the engine runs in a feedback control range of high speeds and high loads and in the feed-forward or open loop control irrespective of an air-to-fuel ratio deviation Daf when out of the feedback control range.

Briefly describing about the feedback control of air-to-fuel ratio, a basic pulse width Bpw, i.e. a basic fuel amount or rate Bfr, is calculated according to a rate of intake air and an engine speed. On the other hand, a feedback control parameter Pfb is calculated based on an air-to-fuel ratio deviation Daf at function block F1. Then, the effective air-to-fuel ratio Eaf is controlled so as to deliver a more enriched fuel mixture if the feedback control parameter Pfb is greater than a neutral value of zero (0) or to deliver a more lean fuel mixture if less than the neutral value of zero (0). At the neutral value of zero (0) of feedback control parameter Pfb, the effective air-to-fuel ratio Eaf is kept unchanged. That is, the basic pulse width Bpw is corrected as a demanded pulse width Dpw, i.e. a demanded fuel amount or rate Dfr, at function block F2 on the basis of the feedback control parameter Dfb, for instance by being multiplied by the feedback control parameter Pfb, so as to reduce the air-to-fuel ratio deviation Daf. When the fuel mixture is lean, i.e. the effective air-to-fuel ratio Eaf is greater than the target air-to-fuel ratio Taf, and consequently, the feedback control parameter Pfb is greater than the neutral value of zero (0), the pulse width is changed larger so as to deliver an increased amount of fuel, whereby the fuel mixture is enriched and changes the effective air-to-fuel ratio to become smaller. In this feedback control, the air-to-fuel ratio deviation Daf diminishes progressively. Conversely, when the fuel mixture is rich and consequently, the feedback control parameter Pfb is smaller than the neutral value of zero (0), the pulse width is changed smaller so as to deliver a decreased amount of fuel, whereby the fuel mixture becomes more lean and changes the effective air-to-fuel ratio to become larger. As a result, the air-to-fuel ratio deviation Daf is diminished progressively. In such a way, the pulse width, i.e. the fuel rate, is feedback controlled according to an air-to-fuel ratio deviation Daf.

In the case the feedback control parameter Pfb remains the neutral value of zero (0), the basic pulse width Bpw is let stand as a demanded pulse width Dpw, controlling the air-to-fuel ratio in the feed-forward of open loop control.

Art effective pulse width Epw, i.e. an effective fuel rate Efr, is adjusted by subtracting a pulse width, namely a vapor replenishment pulse width Rpw, which is determined from a vapor replenishment rate Vrr in such a way as will be described later, from the demanded pulse width Dpw. The fuel injection valve 15 is pulsed with this effective pulse width Epw, injecting the effective fuel rate Efr of fuel into the combustion chamber 4, delivering a target air-to-fuel ratio Taf.

A canister purge control for purging the vapor storage canister 25 takes place upon satisfaction of purge conditions, for instance when the temperature of intake air is not less than a predetermined level, and is performed by activating the solenoid controlled canister purge valve 29 at duties according to running conditions of the engine CE in a manner well known in the art.

In the vapor amount estimation section 30B, the feedback control parameter Pfb obtained at function block F1 is averaged as an average feedback control parameter VPfb, which is an arithmetic mean, at function block F3. Together, a trapped vapor amount Tva is estimated from the average feedback control parameter VPfb at function block F4. In the estimation, the average feedback control parameter VPfb is used as a standard for the judgement whether a true value of trapped vapor amount Tva is greater than the estimated value of trapped vapor amount Tva.

As will be described later, the engine control unit 30 calculates a vapor replenishment rate Vrr by solving a given algebraic equation involving the estimated value of trapped vapor amount Tva and calculates an effective fuel rate Err by subtracting the vapor replenishment rate Vrr from the demanded fuel rate Dfr. In this instance, because, as long as the estimated value of trapped vapor amount Tva is correct or consistent with the true value, the vapor replenishment rate Vrr is accurate, fuel vapors delivered to the combustion chamber 4 either have any effect as a disturbance nor affect the feedback control parameter Pfb. In such a case, if there are not other disturbances, the feedback control parameter Pfb fluctuates only a little above and below the neutral value of zero (0), so that the average feedback control parameter VPfb remains practically the neutral value of zero (0). In other words, when the average feedback control parameter VPfb takes the neutral value of zero (0), the estimated value of trapped vapor amount Tva is consistent with the true value.

Nevertheless, if an estimated value of trapped vapor amount Tva is greater than the true value, a calculated value of vapor replenishment rate Vrr is greater than the true value and consequently, an effective fuel rate Eft diminishes improperly. As a result, fuel is delivered at a rate less than a demanded fuel rate Dfr and consequently, an effective air-to-fuel ratio Efr tends to be more lean. In order to correct the tendency of effective air-to-fuel ratio Efr, the feedback control parameter Pfb changes to above the neutral value of zero (0) so as to deliver a rich effective air-to-fuel ratio Efr. In company with an increase in the effective air-to-fuel ratio Efr, an average feedback control parameter VPfb increases to above the neutral value of zero (0). It is concluded that as long as an average feedback control parameter VPfb is not less than the neutral value of zero (0), an estimated value of trapped vapor amount Tva is greater that the true value. In this instance, as was previously described, because a feedback control parameter Pfb fluctuates, it is not always greater than the neutral value of zero (0) even when an estimated value of trapped vapor amount Tva is greater than the true value and, likewise, an estimated value of trapped vapor amount Tva is not always greater than the true value even when the feedback control parameter Pfb is greater than the neutral value of zero (0). Accordingly, the estimation of trapped vapor amount Tva based on a feedback control parameter Pfb is consider to be extremely inaccurate. This is the reason why the estimation of trapped vapor amount Tva is made based on an average feedback control parameter VPfb in the embodiment.

Conversely, if an estimated value of trapped vapor amount Tva is less than the true value, a calculated value of vapor replenishment rate Vrr is less than the true value and consequently, an effective fuel rate Efr increases improperly. As a result, fuel is delivered at a rate greater than a demanded fuel rate Dfr and consequently, an effective air-to-fuel ratio Efr tends to be more enriched. In such a case, in order to correct the tendency of effective air-to-fuel ratio Efr, the feedback control parameter Pfb changes to below the neutral value of zero (0) so as to deliver a lean effective air-to-fuel ratio Efr. In company with a decrease in the effective air-to-fuel ratio Efr, an average feedback control parameter VPfb decreases to below the neutral value of zero (0). It is also concluded that as long as an average feedback control parameter VPfb is less than the neutral value of zero (0), an estimated value of trapped vapor amount Tva is less than the true value.

Accordingly, as a result of changing an initial value of trapped vapor amount Tva, which has been set as an estimated value, by an decrement of a predetermined correction value $\sigma$ if an average feedback control parameter VPfb is greater than the neutral value of zero (0) or by an increment of the predetermined correction value $\sigma$ if an average feedback control parameter VPfb is less than the neutral value of zero (0), the estimated value of trapped vapor amount Tva converges on the true value as close as possible. In this manner, the true value of trapped vapor amount Tva is obtained based on an average feedback control parameter VPfb. In this instance, it is desired to make a judgement concerning whether an estimated value of trapped vapor amount Tva has approximately reached the true value, i.e. whether the estimation of trapped vapor amount Tva has been completed, based on a predetermined marginal value $\epsilon$ for the absolute value of an average feedback control parameter VPfb. This is because, if the absolute value of an average feedback control parameter VPfb has reached sufficiently near zero (0), it is considered that the estimated value of trapped vapor amount Tva agrees approximately with the true value.

This estimation of trapped vapor amount Tva is satisfied assuming that the correlation described previously is applicable between an trapped vapor amount Tva or a quantitative vapor drawn rate Vdr and a feedback control parameter Pfb or an average feedback control parameter VPfb. Because, if there is an attenuation of such a correlation or such a correlation does not exist between them, highly accurate estimations of trapped vapor amount Tva are rendered difficult or impossible to be made, it is preferred to avoid the estimation of trapped vapor amount Tva based on an average feedback control parameter VPfb. Circumstances where the correlation is attenuated are presented such as when a considerably large amount of intake air is introduced and when the pressure of intake air is significantly low as will be described later. On the other hand, circumstances where the correlation does not exist are presented such as when canister purging is suspended and when the feed-forward or open loop control of air-to-fuel ratio takes place. It may be of course permitted to suspend the estimation of trapped vapor amount Tva when some of these circumstances take place coincidentally.

The estimation of trapped vapor amount Tva is satisfied also assuming that, as long as an accurate vapor replenishment rate Vrr is grasped, i.e. if the replenishment of fuel vapors has no effect to feedback control parameters Pfb, the feedback control parameters Pfb fluctuate above and below the neutral value of zero (0), so as to force an average feedback control parameter VPfb to reach the neutral value of zero (0). In engine control systems for performing learning control of air-to-fuel ratio so as to converge a feedback control parameters Pfb toward the neutral value of zero (0) to make the estimation of a trapped vapor amount Tva, the estimation is preferably made after a termination of such learning control of an air-to-fuel ratio. This is because, if the replenishment of fuel vapors has no effect to feedback control parameters Pfb, the average feedback control parameter VPfb definitely reaches the neutral value of zero (0).

It is to be understood that because, if there occurs continuous suspension of the estimation of trapped vapor amount Tva for a predetermined period of time, an estimated value of trapped vapor amount Tva is presumed to have a deviation from the true value, it is preferred to cancel a result of a judgement of the estimation of trapped vapor amount Tva even though the judgement has been completed.

An estimation time that is defined by a time after the commencement of estimation of trapped vapor amount Tva to a convergence of an estimated value of trapped vapor amount Tva to the neutral value of zero (0) is, on one hand, short, providing a decreased accuracy of the estimation, when the predetermined correction value $\sigma 0$ is large. On the other hand, when the predetermined correction value $\sigma$ is small, while the estimation time is long, an increased accuracy of the estimation is realized. For this reason, it is necessary to establish an appropriate correction value σ so that demands for time and accuracy of the estimation of trapped vapor amount Tva are consistently satisfied. The correction value σ is not always necessary to be constant, but may be changed with, for instance, progress of the estimation of trapped vapor amount Tva or otherwise established according to an average feedback control parameter VPfb. For example, the correction value σ may be set large so as to accelerate the convergence of an estimated value of trapped vapor amount Tva at the beginning of estimation and changed smaller so as to increase the accuracy of estimation after the convergence has progressed to a certain extent. Setting the correction value σ larger with an increase in the average feedback control parameter VPfb provides, on one hand, acceleration of the convergence of an estimated value when an estimated value of trapped vapor amount Tva is far from the true value and, on the other hand, an increase accuracy of estimation when an estimated value of trapped vapor amount Tva is near the true value.

The vapor rate calculation section 30C performs a calculation of a quantitative vapor drawn rate Vdr based on the estimated value of trapped vapor amount Tva and a calculation of a vapor replenishment rate Vrr based on the quantitative vapor drawn rate Vdr. After these calculations, a vapor replenishment pulse width Rpw is calculated so as to correct the demanded pulse width Dpw, whereby an effective pulse width Epw is finally determined. This air-to-fuel ratio feed-forward or open loop control avoids an effect of canister purging to air-to-fuel control without accompanied by any time delay in air-to-fuel ratio control and any deviation of air-to-fuel ratio. Specifically, a pressure difference between before and after the canister purge valve 29 is calculated based on an air charging efficiency at function block F5. On the other hand, an opening in size of the canister purge valve 29 is detected based on a duty Dsr imparted to the solenoid at function block F6. Based on these pressure difference and opening, a rate of air purge Par is calculated in any well known manner at function block F7. The reason why the pressure difference is calculated based on an air charging efficiency is that the pressure of intake air is obtained from an air charging efficiency in a well known manner and a pressure of purge air is regarded to be, on one hand, substantially identical with the intake air pressure immediately after the canister purge valve 29 and, on the other hand, approximately constant, or otherwise identical with the atmosphere immediately before the canister purge valve 29. That is, the pressure difference between before and after the canister purge valve 29 is defined in short as a difference between the atmospheric pressure and intake pressure. Accordingly, the pressure difference can be obtained by applying a mathematical operation to the air charging efficiency. This eliminates the necessity of providing an intake air pressure sensor, simplifying the intake system 10 in structure. There may be of course provided in the evaporation control system 24 a pressure sensor immediately after the canister purge valve 29 or a pressure difference sensor between before and after the canister purge valve 29.

According to one of various well known manners of detecting an air purge rate Par based on the pressure difference between before and after the canister purse valve 29 and the opening in size of the canister purge valve 29, a calculation of the air purge rate Par is grounded on that a functional relation such as $\Delta P=k+u^2$, which is well known in the field of hydrodynamics, is held between a pressure difference, namely a pressure drop ΔP, between before and after a device in a closed pressure line and the flow speed u of a fluid passing through the device. Accordingly, a fluid discharge rate of the device is obtained by multiplying a fluid flow speed u by a cross-sectional area of the device. Accordingly, in the engine control system of this embodiment, since an opening of the canister purge valve 29 is substituted for a cross-sectional area in such a general principle of hydrodynamics, the air purge rate Par is calculated based on a pressure drop ΔP between before and after a device in a closed pressure line and an opening of the canister purge valve 29. In may be of course provided a flow rate sensor to detect directly an air purge rate Par in association with the canister purge valve 29.

At function block F8, a calculation is made to find a quantitative vapor drawn rate Vdr based on the volumetric air purge rate Par and the amount of fuel vapors trapped or stored in the vapor storage canister. Since the air purge rate Par is dependent of temperature, the quantitative vapor drawn rate vdr is corrected according to temperature detected by a temperature sensor 35 at function block F7'. Subsequently, after detecting an engine speed Ne at function block F9, a quantitative vapor ratio (Vdr/Dfr) is calculated at function block F10. In this instance, the quantitative vapor ratio (Vdr/Dfr) is a contribution ratio of the amount of fuel vapors drawn into the purge air line 28 relative to the amount of fuel necessary to be delivered into the engine.

At function block 11, a characteristic model of a delay in purged air and fuel vapor transportation in the path from the vapor storage canister 25 to the engine combustion chamber 4 is established. Thereafter, an effective quantitative vapor ratio Nvr, which is defined as a quantitative vapor ratio of a vapor replenishment rate Vrr to the demanded fuel rate Dfr, is calculated at function block F12. As apparent, an effective fuel rate Efr at which the fuel injection valve 15 injects fuel is determined from the following equation:

$$Efr=Dfr(1-Vrr/Dfr)$$

This effective fuel rate Efr is practically replaced by an effective pulse width Epw as a difference between a vapor replenishment pulse width Rpw and a demanded pulse width Dpw at function block F13.

For this reason, the vapor rate calculation section 30C provides a signal representing a replenishment pulse width Rpw according to the vapor replenishment rate Vrr to the engine control section 30A for reducing the demanded pulse width Dpw by the vapor replenishment pulse width Rpw at function block F13.

The operation of the engine control system depicted in FIGS. 1–3 will be best understood by reviewing FIGS. 4–13, which are flow charts illustrating various sequence routines for a microcomputer of the engine control unit 30. Programming a computer is a skill well understood in the art. The following description is written to enable a programmer having ordinary skill in the art to prepare an appropriate program for the microcomputer. The particular details of any such program would of course depend upon the architecture of the particular computer selected.

Figure 4:
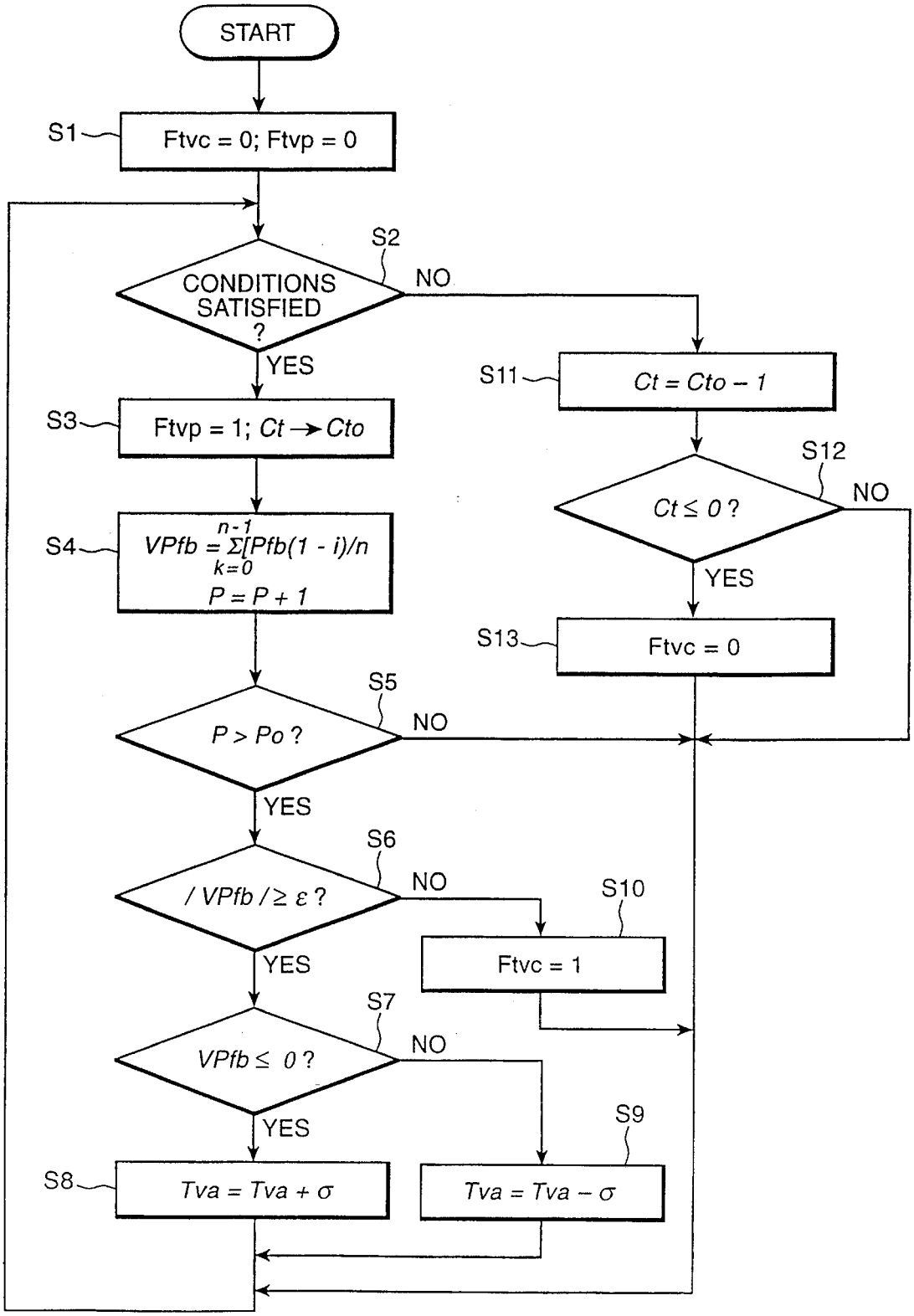
FIG. 4 is a flow chart illustrating a routine of estimating the amount of fuel vapors stored in a vapor storage canister.

FIG. 4 is a flow chart of an estimation routine of trapped vapor amount Tva, which is periodically repeated. The estimation routine commences and control passes directly to a function block at step S1 where initialization is made to reset estimation flags Ftvc and Ftvp in their initial states of 0 (zero) or down. The estimation flag Ftvc indicates that the estimation of trapped vapor amount Tva is continuously prohibited for a predetermined period of time when it is down, namely in the initial state of 0 (zero), and that the estimation of trapped vapor amount Tva has been done when it is up, namely in the state of 1 (one). The estimation flag Ftvp indicates that conditions of the estimation of trapped vapor amount Tva have not yet been satisfied when it is down, namely in the initial state of 0 (zero), and that the conditions have been satisfied and the estimation of trapped vapor amount Tva is ready when it is up, namely in the state of 1. A decision is subsequently made at step S2 as to whether all specified conditions to make the estimation of trapped vapor amount Tva has been satisfied, i.e. whether the engine CE is operating in a condition to permit the estimation of trapped vapor amount Tva to be performed with a high accuracy. In this instance, the conditions meeting the estimation of estimation of trapped vapor amount Tva are predetermined as follows:

(1) The vapor storage canister 25 is being purged;

(2) The air-to-fuel ratio feedback control is being made;

(3) The amount of intake air introduced is less than a predetermined level; and (4) The pressure of intake air introduced is greater than a predetermined level.

On the other hand, if any one of these estimation conditions is not satisfied, i.e. when the vapor storage canister 25 is not being purged, when the air-to-fuel ratio feedback control is not being made, when the amount of intake air introduced is greater than the predetermined level, or when the pressure of intake air introduced is less than the predetermined level, the estimation of trapped vapor amount Tva is suspended. This is because, as described previously, during suspension of canister purling and/or the air-to-fuel ratio feedback control, the correlation is not applicable between an trapped vapor amount Tva or a quantitative drawn rate Vdr and a feedback control parameter Pfb or an average feedback control parameter VPfb. Further, a great amount of intake air not only diminishes considerably the pressure drop $\Delta P$ between before and after the canister purge valve 29 but enhances pulsation of the intake air, causing the feedback control parameters Pfb to fluctuate. Such a fluctuation of the feedback control parameters Pfb renders the estimation of trapped vapor amount Tva difficult to be performed with high accuracy. In addition, a considerably low pressure of intake air boosts the pressure drop $\Delta P$ between before and after the canister purge valve 29 in excess, rendering the estimation of trapped vapor amount Tva difficult to be performed with high accuracy.

Figure 9:
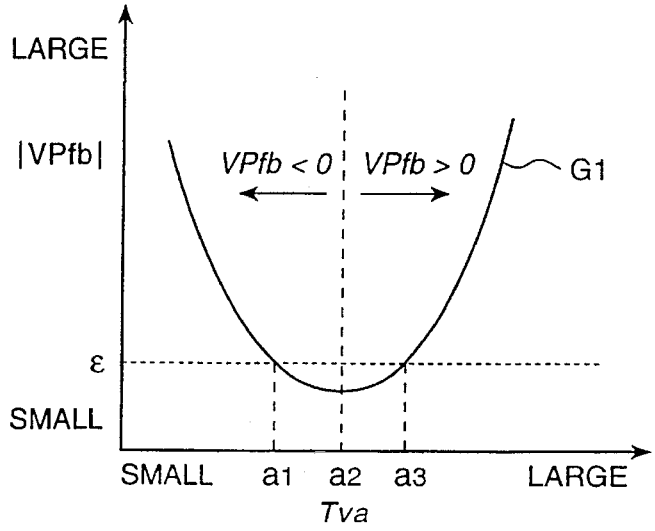
FIG. 9 is a diagram showing the relation between average feedback control parameter and the stored amount of fuel vapors.

If the answer to the decision made at step S2 is "YES," the estimation flag Ftvp is set up to the state of 1 (one) or on and a suspension time counter, which counts a time for which the estimation of trapped vapor amount Tva is continuously suspended, simultaneously resets its count Ct to its initial count Cto at step S3. Subsequently, at step 84, an average feedback control parameter VPfb is calculated from the following equation (I):

$$VPfb = \sum_{k=0}^{n-1} [Pfb(i-k)]/n \quad \text{(I)}$$

where Pfb(i) is the present feedback control parameter;

Pfb (i–k) is the feedback control parameter k times before;

n is the number of samples. Simultaneously, at step S4, a calculation time counter changes its count P, indicating the number of times of calculations of feedback control parameter, by an increment of 1 (one). Thereafter, a decision is made at step S5 as to whether the number of times of average calculations, i.e. the count P is greater than a predetermined number of times Po. If the answer to the decision is "NO," then, the routine returns skipping all following steps S6–S13 and resumes from step S2. This is because the average feedback control parameter VPfb is considered to be unstable and still suffer fluctuations of the feedback control parameters Pfb if the count P is less than the predetermined number of times Po. On the other hand, if the answer to the decision made at step S5 is "YES," this indicates that the average feedback control parameter VPfb is stable, then, a decision is made at step S6 as to whether the absolute value of the average feedback control parameter VPfb is not less than the predetermined marginal value $\epsilon$. If the absolute value of the average feedback control parameter VPfD is less than the predetermined marginal value $\epsilon$, this indicates that the estimation of trapped vapor amount Tva is considered to have been completed and the estimated value of trapped vapor amount Tva is regarded to be consistent with the true value, then, the estimated value of trapped vapor amount Tva is held as it is. After setting the estimation flag Ftvc Up to the state of 1 (one) at step S10, the routine returns skipping all following steps S6–S13 and resumes from step S2. In this instance, as apparent in FIG. 9 showing a curve G1 of absolute values of average feedback control parameter VPfb, when the true value of trapped vapor amount Tva is assumed to be a2, the completion of the estimation of trapped vapor amount Tva is verified by estimated values between a1–a3. In FIG. 2, the average feedback control parameter VPfD is positive for estimated values larger than a2 and is negative for estimated values smaller than a2.

On the other hand, if the absolute value of the average feedback control parameter VPfb is not less than the predetermined marginal value $\epsilon$, i.e. the answer to the decision made at step S6 is "YES," a further decision is made at step S7 as to whether the average feedback control parameter VPfb is equal to or less than 0 (zero). According to a result of the decision, the estimated value of trapped vapor amount Tva is increasingly or decreasingly changed. Specifically, if the answer to the decision is "Yes," i.e. if the average feedback control parameter VPfb is equal to or less than 0 (zero), the estimated value of trapped vapor amount Tva is increased by a correction value $\sigma$ at step S8. On the other hand, if the answer to the decision is "NO," i.e. if the average feedback control parameter VPfb is not less than 0 (zero), the estimated value of trapped vapor amount Tva is decreased by a correction value $\sigma$ at step S9.

If the answer to the decision made at step S2 in regard to satisfaction of the specified conditions for the estimation of trapped vapor amount Tva is "NO," after having changed the count Ct of the suspension time counter by a decrement of 1 (one) and caused the suspension time counter no count down the initial count Cto for a time for which the estimation of trapped vapor amount Tva is continuously suspended and simultaneously, reset the calculation time counter to zero (0) at step S11, a decision is made at step S12 as to whether the count Ct of the suspension time counter has reached zero (0), i.e. whether a suspension time represented by the initial count Cto has passed. If the answer to the decision is "YES," after having reset the estimation flag Ftvc down to the state of 0 (zero) at step S13, the routine returns and resumes from step S2. In this instance, because, as was previously described, there is possibly a deviation of the estimated value of trapped vapor amount Tva from the true value, the estimation flag Ftvc is reset down. On the other hand, if he answer to the decision is "NO," this indicates that the suspension time represented by the initial count Cto has not yet passed, then, the routine returns directly and resumes from step S2.

Figure 10:
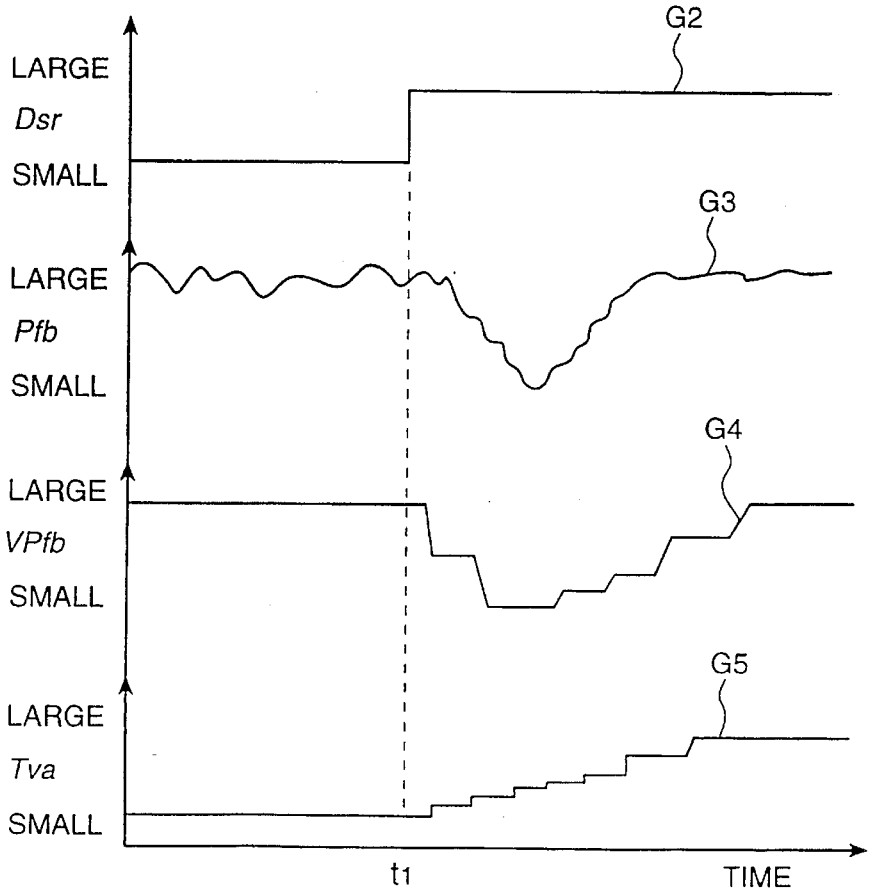
FIG. 10 is diagrams showing changes in various control factors due to aging.

FIG. 10 is an exemplary chart showing varying values, namely a duty DSr (G1), a feedback control parameter Pfb (G3), an average feedback control parameter VPfb (G4) and an estimated value of trapped vapor amount Tva (G5). As apparent from FIG. 10, an estimated value of trapped vapor amount Tva reaches a constant value before long after the commencement of estimation at a time t1. In such a manner, the estimation of trapped vapor amount Tva is performed with a high accuracy.

Figure 5:
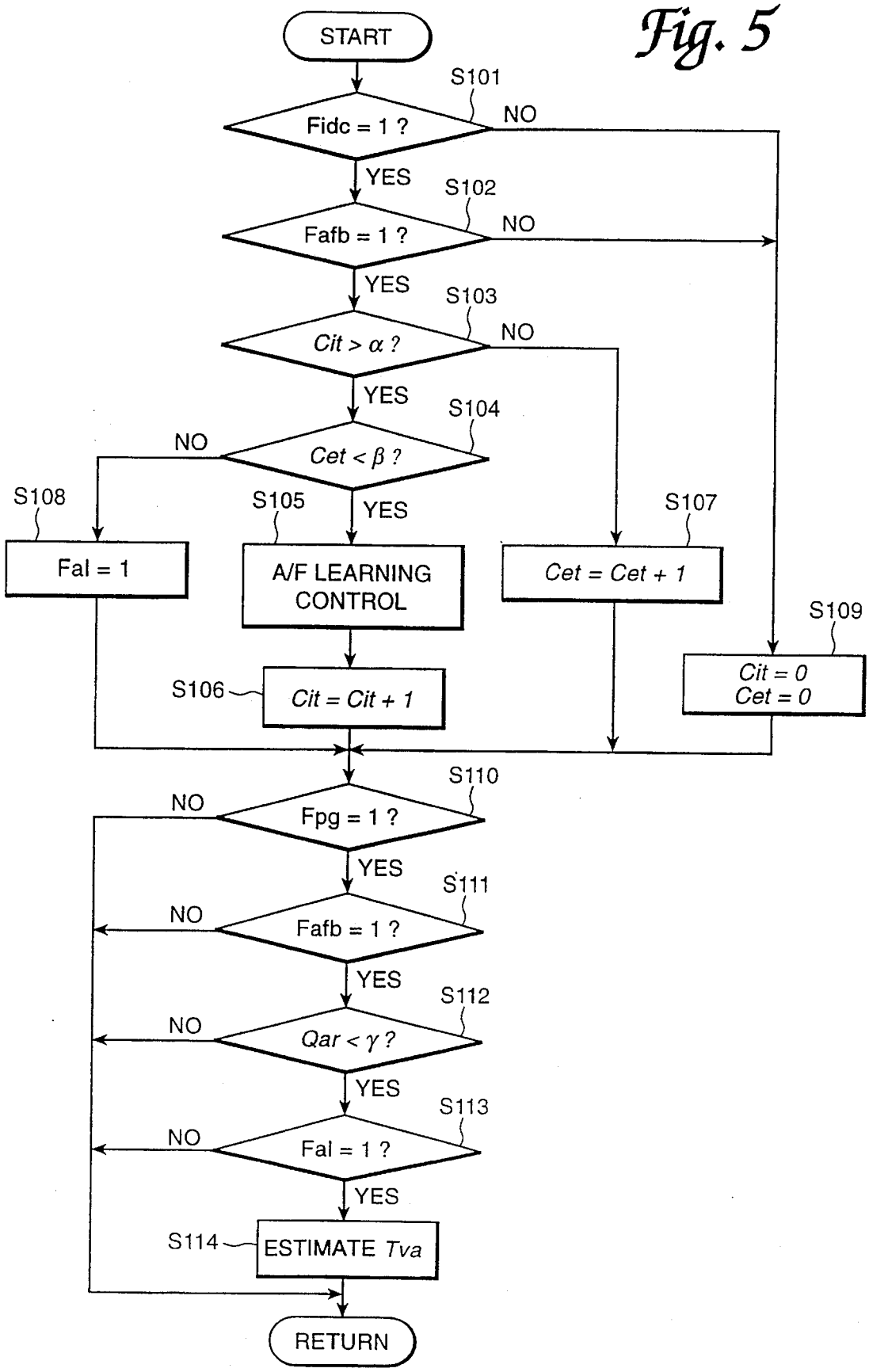
FIG. 5 is a flow chart illustrating a routine of estimating the amount of fuel vapors stored in a vapor storage canister in the case where learning control is executed for air-to-fuel feedback control.

FIG. 5 is a flow chart of a routine of the estimation of trapped vapor amount Tva performed after termination of leasing control of an air-to-fuel ratio which is beneficial, if employed, as was previously described. In this estimation routine of trapped vapor amount Tva, the learning control of an air-to-fuel ratio is performed when specified learning control conditions are satisfied basically during idling and the estimation of trapped vapor amount Tva is performed when specified estimation conditions are satisfied after idling and since a termination of the leasing control of an air-to-fuel ratio.

The estimation routine commences and control passes directly to a function block at step S101 where a decision is made as to whether an idle flag Fidc has been set up to a state of 1 (one). The idle flag Fidc indicates that the engine CE is idling when it has been set up to the state of 1 (one) and that the engine CE is not idling when it has been reset down to a state of 0 (zero). Idling is one of necessary condition for air-to-fuel learning control. If the answer to te decision is "YES," then, another decision is made at step S102 as to another condition for the air-to-fuel learning control, i.e. whether a feedback control flag Fafb has been set up to a state of 1 (one). The feedback control flag Fafb is set up to the state of 1 (one) when the air-to-fuel feedback control is being performed and reset down to a state of 0 (zero) when it is not performed, i.e. when an air-to-fuel open-loop control is being performed. If the answer to the decision is "YES," then decisions are consecutively made at steps 103 and 104, respectively whether an idle time counter has counted more than a predetermined number of times $\alpha$ of idling and, if "Yes," whether a learning time counter has not yet counted a predetermined number of times Cet of learning. The learning time counter counts the number of times Cet of execution of the air-to-fuel leaning control after idling. In this instance, a termination of the air-to-fuel leaning control is judged with the count of predetermined number of times $\beta$. In this instance, the feedback control flag Fafb is set up to the state of 1 (one) when the air-to-fuel feedback control is being performed and reset down to a state of 0 (zero) when it is not performed, i.e., when an air-to-fuel open-loop control is being performed. Further, the time Cit counted by the idle time counter is an idle time of duration from the commencement of idling. Because it is assumed that the engine CE has not yet been stable in operation until the idle time of duration reaches the predetermined idle time $\alpha$, the air-to-fuel leaning control is prohibited for that period. If the answer to either decision made at S102 or S103 is "NO," the air-to-fuel leaning control is prohibited and the routine forwards to steps S111 through S115 for the estimation of trapped vapor amount Tva after having reset both the number of times Cet of the learning time counter and the idle duration time Cit of the idle time counter to zero (0) at step S110. If the answer to the decision concerning the predetermined idle time of duration $\alpha$ is "NO," then, after having caused the learning time counter to change the count indicating the number of times Cet by an increment of 1 (one) at step S107, the routine forwards to steps S111 through S115 for the estimation of trapped vapor amount Tva. Further, if the answer to the decision concerning the predetermined number of times $\beta$ of learning is "NO," then, after having set up leaning control flag Fal, the routine forwards to steps S111 through S115 for the estimation of trapped vapor amount Tva.

When the learning time counter has not yet counted the predetermined number of times $\beta$ of execution of the air-to-fuel leaning control, i.e.. the answer to the decision is "YES," the air-to-fuel leaning control continues at step S105. The air-to-fuel leaning control changes the amount of fuel injected by the fuel injection valves 15 so as to force a feedback control parameter Pfb to become, on average, equal approximately to the neutral value of zero (0) when the air-to-fuel ratio has no deviation. After having caused the idle time counter to change the count indicating the idle duration time Cit by an increment of 1 (one) at step S106, the routine makes decisions at steps S110 through S113 as to satisfaction of various conditions for the estimation of trapped vapor amount Tva.

Decisions made at steps S110 through S113 are whether the following four estimation conditions have been satisfied. When all of the estimation conditions are satisfied, it is judged that the estimation of trapped vapor amount Tva is ready to be performed. These estimation conditions include.

(1) The vapor storage canister 25 is being purged;

(2) The air-to-fuel ratio feedback control is being made;

(3) The rate of intake air introduced per unit time is less than a predetermined level; and (4) The air-to-fuel ratio learning control has terminated. The first three conditions (1)–(3) are provided for the same reason as for the estimation routine of trapped vapor amount Tva previously described in connection with the flow chart shown in FIG. 4. The last condition (4) yields a high accuracy of estimation.

Specifically describing, the conditions (1) (2) and (4) are judged to be satisfied when a purge flag Fpg, the feedback control flag Fafb and the learning control flag Fal have been set up to their states of 1 (one), respectively. Together the condition (3) is judged with a predetermined intake rate $\gamma$. If all these estimation conditions (1)–(4) are satisfied, i.e. the answer to each of the decisions made at steps S111–S114 is "YES," then, the estimation routine of trapped vapor amount Tva such as illustrated by a flow chart in FIG. 4 is performed at step S114. On the other hand, any one of these estimation conditions is not satisfied, the routine returns and resumes.

As apparent, even when the engine is not in idling, the estimation of trapped vapor amount Tva is performed as long as an air-to-fuel ratio is in the feedback control zone.

Figure 6:
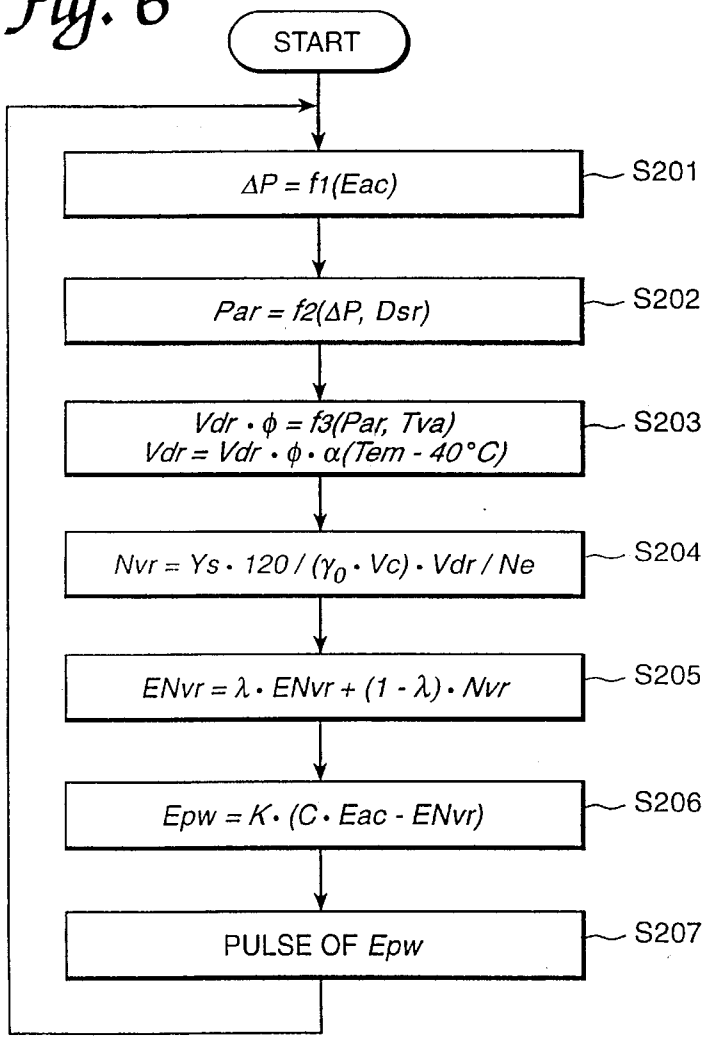
FIG. 6 is a flow chart illustrating a routine of determining the amount of fuel to be delivered by an injector.

FIG. 6 shows a flow chart of a control routine of the amount of fuel delivered by the fuel injection valve 15, which is periodically repeated. The fuel control routine commences and control passes directly to a function block at step S201 where a pressure drop $\Delta P$ between before and after the canister purge valve 29 is obtained by looking up a table T1 for pressure drops with respect to air charging efficiency Eac. In the pressure drop look up table T1 is defined by a functional relation having an air charging efficiency Eac as an independent variable and a pressure drop $\Delta P$ as a dependent variable. Subsequently, an air purge rate Par is found according to the pressure drop $\Delta P$ and the duty Dsr imparted on the solenoid controlled canister purge valve 29 by searching an air purge rate map. This air purge rate map is defined by a functional relation having a pressure drop $\Delta P$ and a duty Dsr as independent variables and an air purge rate Par as a dependent variable. In place of using such a look up table, a function, such as $\Delta P=f_1(Eac)$, may be used so as to find directly a pressure drop $\Delta P$ with respect to an air charging efficiency Eac. Similarly, in place of using such an air purge rate map, a function, such as $Par=f_2(\Delta P, Dsr)$, may be used so as to find directly an air purge rate Par with respect to a pressure drop $\Delta P$ and a duty Dsr.

Figure 11:
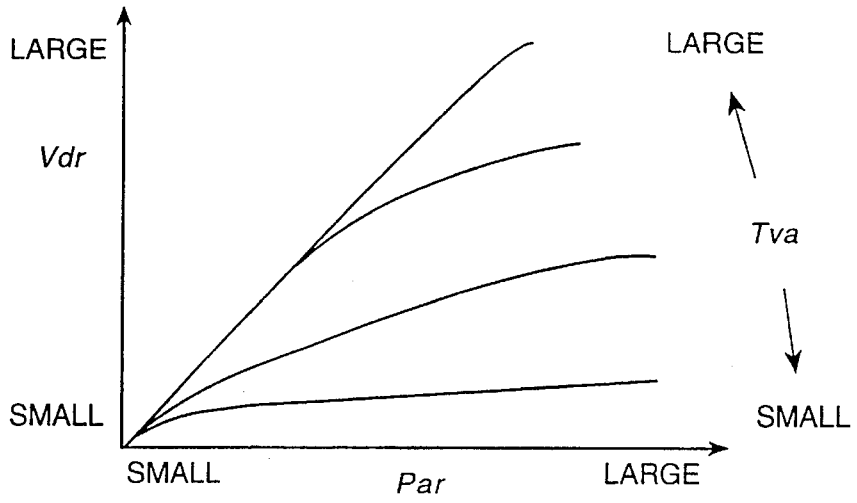
FIG. 11 is a diagram showing the dependency of the amount of fuel vapor drawn from the vapor storage canister relative to the amount of purged air and the amount of fuel vapors stored in the vapor storage canister.
Figure 16:
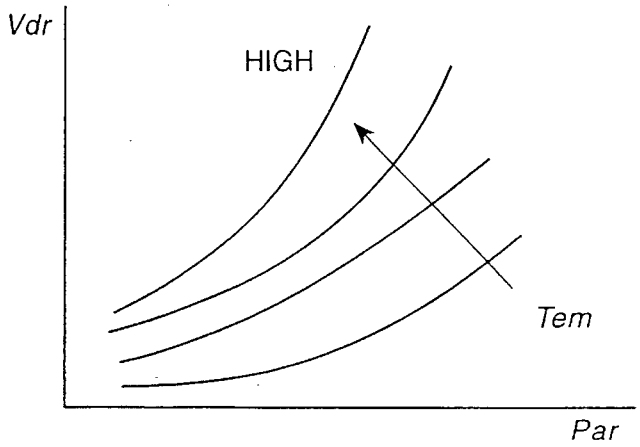
FIG. 16 is a diagram showing the dependency of the amount of trapped fuel vapors on temperature.

At step S203, a quantitative draw rate Vdr is found according to the air purge rate Par and the estimated value of trapped vapor amount Tva by searching a vapor draw rate map. This vapor draw rate map is defined by a functional relation having an air purge rate Par and an estimated value of trapped vapor amount Tva as independent variables and a quantitative draw rate Vdr as a dependent variable. In place of using such a map, a function, such as $Vdr\cdot\phi=f_3(Par, Tva)$, may be used so as to find directly a quantitative draw rate Vdr with respect to an air purge rate Par and an estimated value of trapped vapor amount Tva. An effective quantitative draw rate vdr is calculated, taking temperature into consideration, from an equation, such as $Vdr=Vdr\cdot\phi\cdot\alpha(Tem-40°\ C.)$. In this equation, $\alpha$ is a coefficient. As shown in FIG. 16, the quantitative draw rate $Vdr\cdot\phi$ has a dependency of temperature Tem. An example of a vapor draw rate map of trapped vapor amounts Tva is shown in FIG. 11 in which dependency of air draw rate Vdr upon air purge rates Par and estimated value of trapped vapor amount Tva is depicted. It is understood that the function, such as $Vdr=f_3(Par, Ddr)$, may be used, in place of using such an air purse rate map, so as to find directly an air draw rate Vdr with respect to an air purge rates Par and an estimated value of trapped vapor amount Tva.

Thereafter, a vapor ratio Nvr is calculated from the following equation (II) at step S204:

$$Nvr=Ys\cdot 120/(\gamma_o\cdot Vc)\cdot Vdr/Ne \quad \text{(II)}$$

where Ys is the conversion factor;

$\gamma_o$ is the density of vapor;

Vc is the effective volume of cylinder;

Vdr is the quantitative drawn rate Vdr; and

Ne is the rotational speed of engine.

In the equation (II), since the term of $120/(\gamma_o\cdot Vc\cdot Ne)$ represents a reciprocal number of the mass flow rate of intake air into the combustion chamber 4 per unit time (second) and consequently, the terra of $Ys\cdot 120/(\gamma_o\cdot Vc\cdot Ne)$ represents a reciprocal number of the demanded fuel rate Dfr per unit time (second), the quantitative vapor ratio Nvr is a ratio of the quantitative drawn rate Vdr relative to the demanded fuel rate Dfr, and hence a total fuel flow rate.

At step S205, a net quantitative vapor ratio ENvr is calculated from the following equation (III):

$$ENvr=\gamma\cdot ENvr+(1-\lambda)\cdot Nvr \quad \text{(III)}$$

where $\lambda$ is the first order filtering factor ($0<\lambda<1$).

This equation (III) represents a simulation model representative of a delay characteristic of the purge line. The equation (III) gives an accurate net quantitative vapor ratio ENvr with the first order filtering factor $\lambda$ properly established according to the configuration of the purge line including the intake system 10, the assist air delivery system 16 and the purge air line 28.

Further, at step S206, an effective pulse width Epw is calculated from the following equation (IV):

$$Epw=K\cdot(c\cdot Eac-ENvr) \quad \text{(IV)}$$

where K is the conversion factor;

c is the correction factor; and

Eac is the air charging efficiency.

Since the term of $K\cdot c\cdot Eac$ represents a demanded pulse width Dpw corresponding to the demanded fuel rate Dfr at which fuel is introduced into the combustion chamber 4, and the term of $K\cdot ENvr$ represents a vapor replenishment pulse width Rpw corresponding to the vapor replenishment rate Vrr, the effective pulse width Epw given bt the equation (IV) represents an effective fuel rate Efr at which fuel is actually injected through the fuel injection valve 15.

Finally, an injection pulse with the effective pulse width Epw is imparted on the fuel injection valve 15 at step 207. The final step orders return and the routine resumes.

According to the control as described above, an accurate amount of fuel necessary to engine operating conditions is supplied to the combustion chamber 4, providing an air-to-fuel ratio accurately remaining the target ratio. Because though the demanded amount of fuel is regulated according to engine operating conditions in feedback or closed-loop control, the effective amount of fuel is regulated in feed-forward or open-loop control so as to eliminate an effect of canister purging to the air-to-fuel control, the calculation of a net quantitative vapor ratio ENvr or a vapor replenishment rate Vrr is performed with no time delay. Consequently, there does not occur any deviation of an effective air-to-fuel ratio Eaf relative to the target ratio resulting from canister purging.

Figure 12:
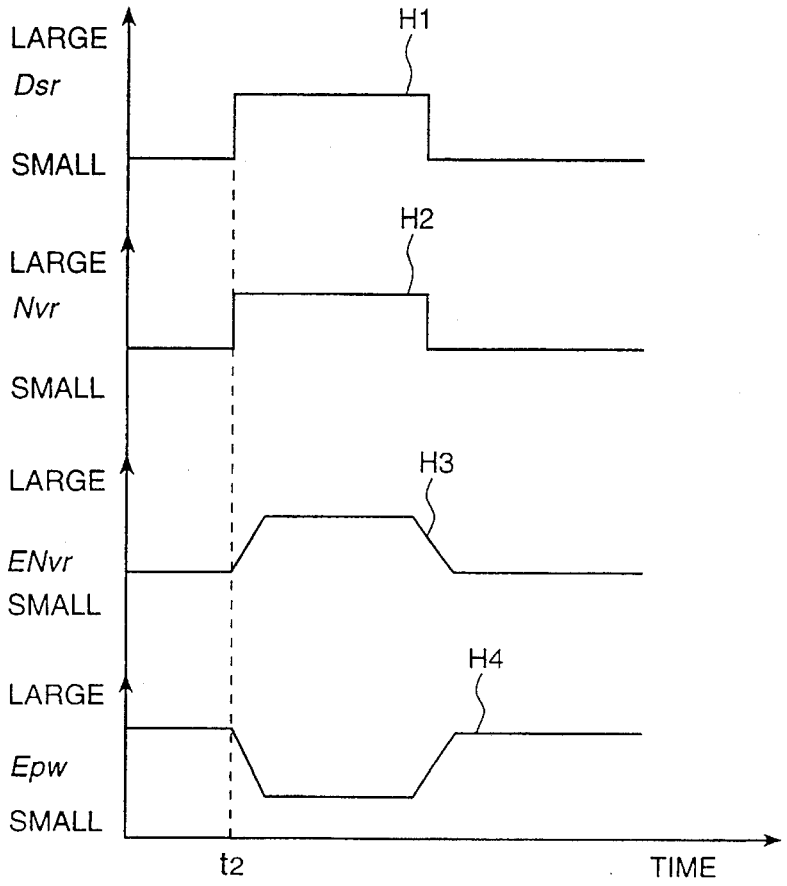
FIG. 12 is a diagrams showing changes in various control factors due to aging.
Figure 13:
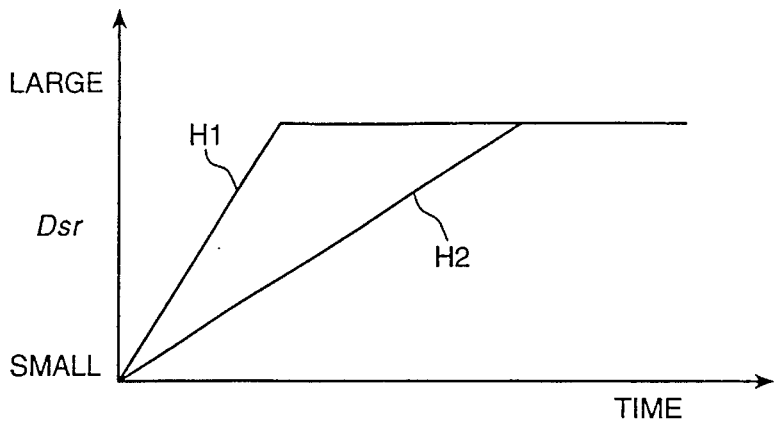
FIG. 13 is a diagram showing changes duty rate due to aging.

FIG. 12 is an exemplary chart showing varying values, since a time $t_2$ of the commencement of canister purging, namely a duty Dsr (H1), a quantitative vapor ratio Nvr (H2), a net quantitative vapor ratio ENvr (H3) and an effective pulse width Epw (H4).

With the control routine of fuel delivery, because an effective fuel rate Efr is calculated by subtracting a vapor replenishment rate Vrr, which is accurately calculated based on an estimated value of trapped vapor amount Tva, from a demanded fuel rate Dfr, fuel vapors, introduced into the intake system 10 or the combustion chamber 4 due to canister purging, does not serve as disturbances affecting the feedback control of air-to-fuel ratio. Accordingly, canister purging causes any deviation of an air-to-fuel ratio from the target value after completion of the estimation of trapped vapor amount Tva. However, because it is uncertain to obtain an accurate net quantitative vapor ratio ENvr or an accurate vapor replenishment rate Vrr until a completion of the estimation of trapped vapor amount Tva, i.e. the estimation flag Ftvc is reset down to the state of 0 (zero), it is desirable to control canister purging until the completion of the estimation of trapped vapor amount Tva. For example, such canister purging may be prohibited until the completion of the estimation of trapped vapor amount Tva, or otherwise performed at an decreased air purge rate. The prohibition of canister purging may be performed only during idling.

It is also desirable for prevention of a rapid change in fuel delivery rate upon resumption of canister purging to increase gradually a duty Dsr imparted on the solenoid controlled canister purse valve 29 to a target duty TDsr meeting an engine operating condition. In the case where a duty Dsr imparted on the solenoid controlled canister purge valve 29 is gradually increased to a target TDsr, it is preferred to keep a change in the duty Dsr small at the beginning of resumption of canister purging until a completion of the estimation of trapped vapor amount Tva and to increase it after the completion of the estimation of trapped vapor amount Tva.

Figure 7:
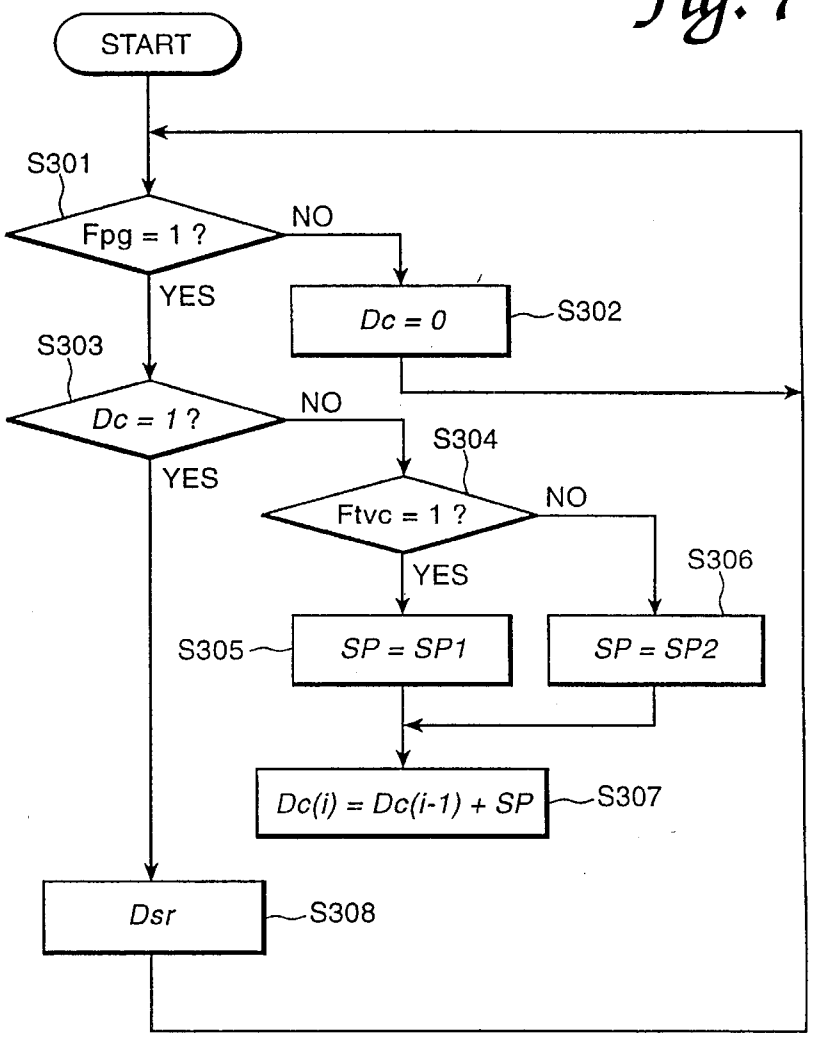
FIG. 7 is a flow chart illustrating a routine of determining a rate of purging at the commencement of purging.

FIG. 7 is a flow chart of control routine of a gradual increase of duty at the beginning of resumption of canister purging. The first step at step S301 in this duty control routine is to make a decision as to whether the purge flag Fpg has been set up to the state of 1 (one). If the answer to the decision is "NO," after setting a duty conversion factor Dc to 0 (zero) at step S302, the control routine resumes. In this instance, the duty conversion factor Dc is a value larger than 0 (zero) but smaller than 1 (one) used to convert a target duty TDsr established according to engine operating conditions into an effective duty Dsr. That is, an effective duty Dsr is given as the product of a target duty TDsr and the duty conversion factor Dc. The duty conversion factor Dc is set 0 (zero) until resumption of canister purging and gradually changed by increments of SP after the resumption of canister purging. Once the duty conversion factor Dc reaches 1 (one), it is kept unchanged. As long as the duty conversion factor Dc is 0 (zero), canister purging is suspended in spite of a target duty TDsr. On the other hand, when the duty conversion factor Dc remains 1 (one), the canister purge valve 29 is driven with a target duty TDsr.

If the answer to the decision made at step S301 is "YES," another decision is made at step S303 as to whether the duty conversion factor Dc is 1 (one). If the answer to the decision is "NO," i.e. the duty conversion factor DC is less than 1 (one), then, the duty conversion factor Dc is gradually increased after commencement of canister purging at steps S304 through S307. Specifically, at step S304, a decision is made as to whether the estimation flag Ftvc has been set up to the state of 1 (one), i.e. the estimation of trapped vapor amount Tva has been completed. If the answer to the decision is "YES," after having increased the increment value of SP to a relatively large value of SP1 at step S305, the preset duty conversion factor DC(i) is calculated by changing the last duty conversion factor Dc(i−1) by an increment of the value of SP1 at step S307. However, if the present duty conversion factor Dc(i) is larger than 1 (one), it is clipped to 1 (one). Because a completion of the estimation of trapped vapor amount Tva yields an accurate calculation of a net quantitative vapor ratio ENvr or an accurate vapor replenishment rate Vrr, the feed-forward or open loop control certainly avoid an effect of canister purging. That is, even if resumption of canister purging is abrupt to a certain extent, there does not occur an adverse effect of canister purging such as a disturbance against the air-to-fuel control. Because of this, the duty conversion factor Dc is changed at an increased rate so as to resume canister purging with a target duty TDsr early enough. In such the case where the estimation of trapped vapor amount Tva has been completed, an effective duty Dsr has the changing feature shown by a characteristic line L1 in FIG. 13. A horizontal part of the characteristic line L1 represents a target duty.

On the other hand, if the answer to the decision made at step S304 is "NO," after having increased the increment value of Sp to a relatively small value of SP2, which is smaller than the value SP1, at step S306, the preset duty conversion factor Dc(i) is calculated by changing the last duty conversion factor Dc(i−1) by an increment of the value of SP1 at step S307. It is of course to clip the value of SP1 to 1 (one). In this event, because an incompletion of the estimation of trapped vapor amount Tva does not yield an accurate calculation of a net quantitative vapor ratio ENvr or an accurate vapor replenishment rate Vrr, the feed-forward or open loop control does not serve sufficiently. Consequently, abrupt resumption of canister purging has an adverse effect to provide disturbances against the air-to-fuel control. Because of this, the duty conversion factor Dc is changed at a decreased rate so as to resume canister purging slowly early enough. In such the case where the estimation of trapped vapor amount Tva has not yet been completed, art effective duty Dsr has the changing feature shown by a characteristic line L2 in FIG. 13.

Finally, after the calculation of an effective duty Dsr at step S307 or if the answer to the decision made at step S303 is "YES," an effective duty Dsr is calculated from the following equation (V) at step S308:

$$Dsr=Dc\cdot TDsr(Ne,\ Eac) \qquad (V)$$

where the term TDsr(Ne, Eac) is defined by a target duty TDsr found according to an air charging efficiency EaC and an engine speed Ne by searching a target duty map which is defined by a functional relation having an air charging efficiency Eac and an engine speed Ne as independent variables and a duty Dsr as a dependent variable. In such a way, immediately before resumption of the estimation of trapped vapor amount Tva, art effective duty Dsr, and hence an air purge rate, is gradually increased. The final step orders return and the routine resumes.

Figure 8:
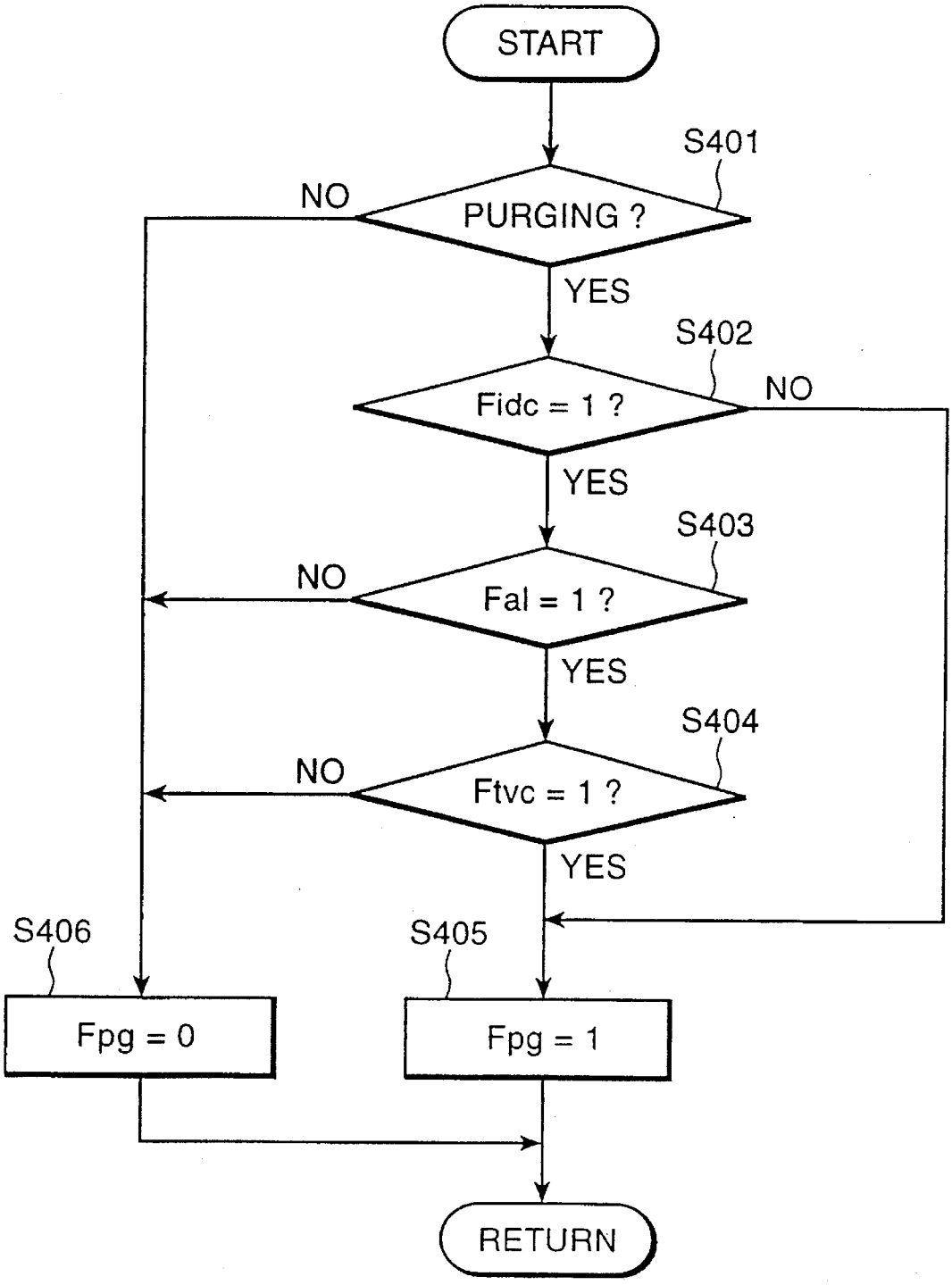
FIG. 8 is a flow chart illustrating a routine of purging during idling.

FIG. 8 is a flow chart of the control routine of canister purging during idling. the control routine commences and passes directly to a function block S401 where a decision is made as to whether purging is permitted to take place. In this instance, when the temperature of engine coolant is higher than, for example, 80° C. and an air-to-fuel ratio is within the feedback control range, purging is allowed. If the answer to the decision is "YES," a decision is made at step S402 as to whether the idle flag Fidc has been set, i.e. the engine CE is in idling. If "YES," decisions are made at steps S403 and 404, respectively, in order to judge whether conditions for canister purging during idling are satisfied. In this instance, canister purging is performed when the canister purging conditions as to both the learning air-to-fuel ratio control and the estimation of trapped vapor amount Tva have been completed. Specifically, a decision as to the learning air-to-fuel ratio control and a decision of the estimation of trapped vapor amount Tva are consecutively made. If both these conditions have been satisfied, the purge flag Fpg is set up at step S405. This purge flag Fpg is referred to for execution of the canister purging at step S110 of the raped vapor estimation routine shown in FIG. 5. However, if any one of these conditions has been unsatisfied, the purge flag Fpg is set down for prohibition of the canister purging at step S406 for prohibition of the canister purging. This control routine enables the canister purging to be performed during idling without causing disturbances against the air-to-fuel ratio control and any deviation of an air-to-fuel ratio from the target ratio.

Figure 15:
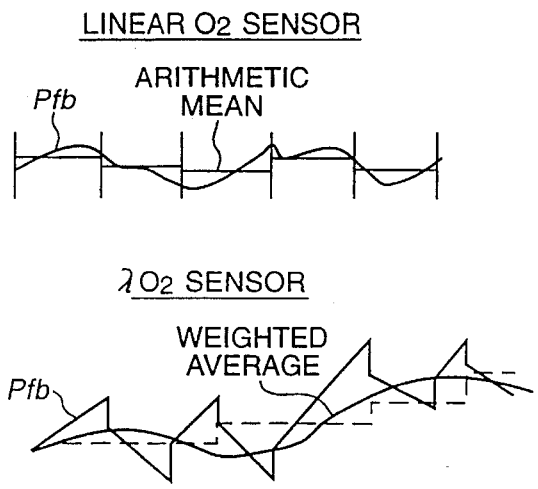
FIG. 15 is diagrams showing outputs from a linear oxygen ($O_2$) sensor and a λ-oxygen ($O_2$) sensor, respectively and average feedback control parameters.
Figure 14:
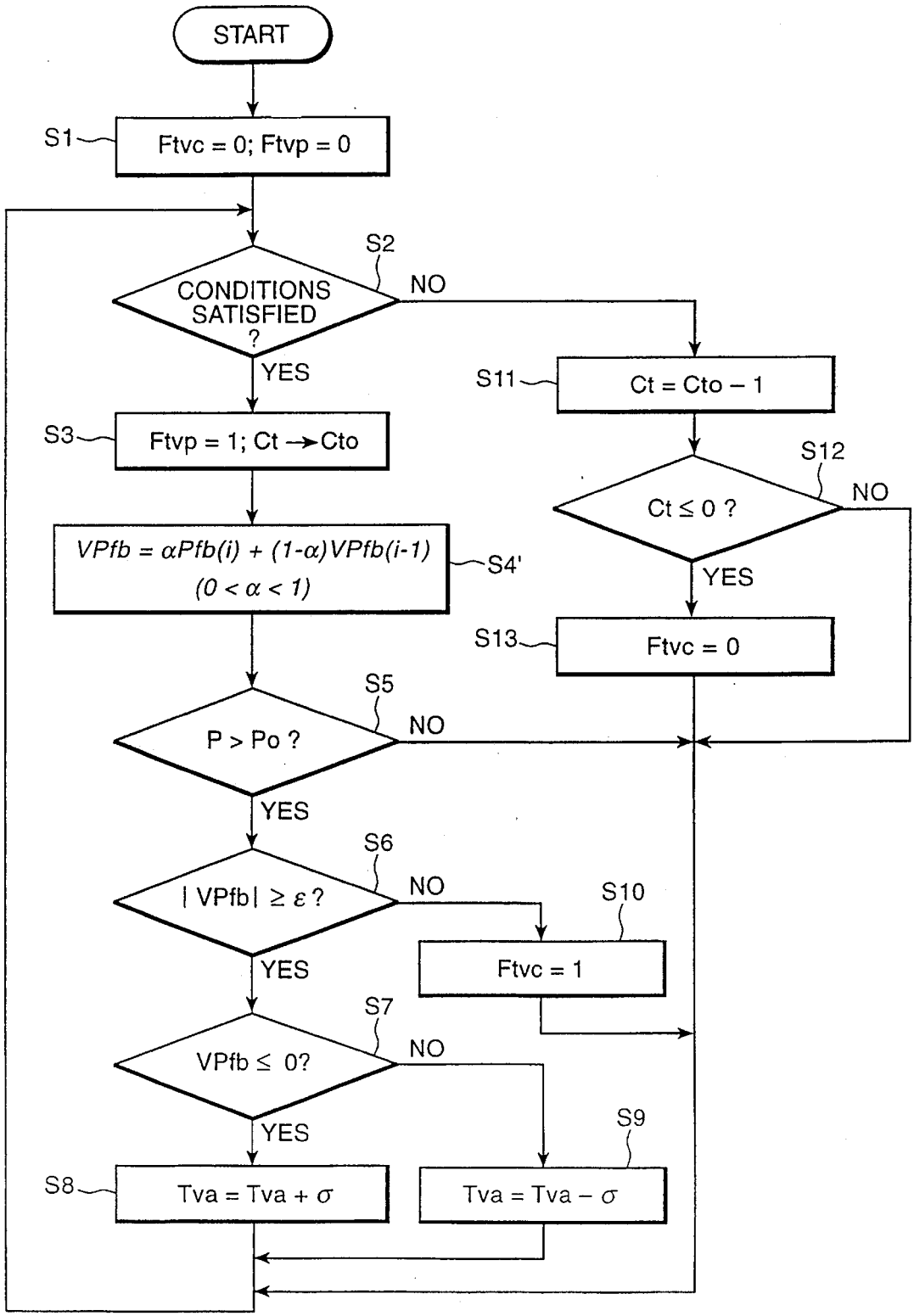
FIG. 14 is a flow chart illustrating a routine of estimating the amount of fuel vapors stored in a vapor storage canister similar to FIG. 1.

In order to attain an average feedback control parameter VPfb, a weighted average of feedback control parameter VPfb may be employed in place of an arithmetic mean of feedback control parameter VPfb. For this weighted average feedback control parameter VPfb, what is called a λ-oxygen ($O_2$) sensor may be used. Such a λ-oxygen ($O_2$) sensor is considerably sensitive to a change in air-to-fuel ratio traversing an ideal or target air-to-fuel ratio. As shown in FIG. 15, the λ-oxygen ($O_2$) sensor provided an output gently changing according to a varying feedback control parameter. In the estimation of trapped vapor amount Tva illustrated by a flow chart shown in FIG. 14, which is substantially similar to that shown in FIG. 4, an average feedback control parameter VPfb is calculated as a weighted average at Step S4'.

It is to be understood that whereas, in order for the engine control system described in the above embodiment to calculate a vapor drawn rate (a quantitative vapor ratio) or a vapor replenishment rate (a net quantitative vapor ratio), a trapped vapor amount is estimated on the basis of an average feedback control parameter, nevertheless, it may be directly detested by means of a vapor detecting means such as for detecting the amount of vapors based on an electrostatic capacity of fuel vapor absorbing materials in the vapor storage canister 25 or by means of a hydrocarbon (HC) sensor.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A fuel system comprising:

air-to-fuel ratio control means for detecting an air-to-fuel ratio and feedback controlling said air-to-fuel ratio according to a feedback control parameter determined based on a deviation of said air-to-fuel ratio from a target air-to-fuel ratio so as to maintain an ideally combustible air-fuel mixture;

evaporation control means included in said fuel system and having a purge valve for storing fuel vapors from a fuel tank and purging fuel vapors into an intake system therefrom; and fuel control means for calculating an average of said feedback control parameters, estimating an amount of said fuel vapors stored in said evaporation control means based on said average feedback control parameter, calculating an amount of fuel vapors replenished into said intake system based on said estimated amount of fuel vapors, and calculating a difference between an amount of fuel necessary to provide an ideally combustible air-fuel mixture and said replenished amount of fuel vapors, whereby causing said fuel system to deliver fuel of an amount equal to said difference into said intake system.

2. A fuel system as defined in claim 1, wherein said fuel control means changes said estimated amount of fuel vapors in a preceding control cycle according to a difference of said average feedback control parameter from a predetermined neutral value.

3. A fuel system as defined in claim 2, wherein said fuel control means increases said estimated amount of fuel vapors larger with an increase in said average feedback control parameter.

4. A fuel system as defined in claim 1, wherein said fuel control means suspends estimation of an amount of fuel vapors stored in said evaporation control means when said feedback control parameter is less correlative to an amount of fuel vapors stored in said evaporation control means.

5. A fuel system as defined in claim 4, wherein said fuel control means suspends estimation of an amount of fuel vapors stored in said evaporation control means in a condition where evaporation control means suspends purging fuel vapors stored therein into said intake system.

6. A fuel system as defined in claim 4, wherein said fuel control means suspends estimation of an amount of fuel vapors stored in said evaporation control means in a condition where an amount of air introduced into said intake system is less than a predetermined level.

7. A fuel system as defined in claim 4, wherein said fuel control means suspends estimation of an amount of fuel vapors stored in said evaporation control means in a condition where pressure of air introduced into said intake system is lower than a predetermined level.

8. A fuel system as defined in claim 4, wherein said fuel control means suspends estimation of an amount of fuel vapors stored in said evaporation control means in a condition where said air-to-fuel ratio control means suspends feedback control.

9. A fuel system as defined in claim 1, wherein said fuel control means suspends estimation of an amount of fuel vapors stored in said evaporation control means on an occurrence of at least one of conditions where evaporation control means suspends purging fuel vapors stored therein into said intake system, where an amount of air introduced into said intake system is less than a predetermined level, where pressure of air introduced into said intake system is lower than a predetermined level, and where said air-to-fuel ratio control means suspends feedback control.

10. A fuel system as defined in claim 1, wherein said fuel control means provides a decision of completion of said estimation of an amount of fuel vapors stored in said evaporation control means when an absolute value of said average feedback control parameter is less than a predetermined level.

11. A fuel system as defined in claim 10, wherein said fuel control means withdraws said decision when said fuel control means suspends continuously estimation of an amount of fuel vapors stored in said evaporation control means for more than a predetermined period of time.

12. A fuel system as defined in claim 1, wherein said air-to-fuel ratio control means performs learning of control characteristics so as to converge said feedback control parameter toward a predetermined neutral value, and said fuel control means commences estimation of an amount of fuel vapors stored in said evaporation control means after said learning has been completed.

13. A fuel system as defined in claim 1, wherein said air-to-fuel ratio control means includes a linear oxygen ($O_2$) sensor for detecting an oxygen ($O_2$) content of exhaust gas as an air-to-fuel ratio even in a range of air excess rates higher than 1 (one) and said fuel control means calculates, as said average feedback control parameters, an arithmetic mean of said feedback control parameters sampled at predetermined intervals.

14. A fuel system as defined in claim 1, wherein said air-to-fuel ratio control means includes a linear oxygen ($O_2$) sensor for detecting an oxygen ($O_2$) content of exhaust gas as an air-to-fuel ratio even in a range of air excess rates higher than 1 (one) and said control means calculates, as said average feedback control parameters, a weighted average of said feedback control parameters sampled at predetermined intervals.

15. A fuel system as defined in claim 1, wherein said air-to-fuel ratio control means includes a $\lambda$-oxygen ($O_2$) sensor for detecting that exhaust gas contains air of an air excess rate higher than 1 (one) and said fuel control means calculates, as said average feedback control parameters, a weighted average of said feedback control parameters sampled at predetermined intervals.

16. A fuel system as defined in claim 1, wherein said fuel control means further calculates a rate of fuel vapors purged into said intake system from said evaporation control means based on said estimated amount of fuel vapors.

17. A fuel system as defined in claim 16, wherein said fuel control means calculates a rate of fuel vapors drawn from said evaporation control means toward said intake system and calculates a rate of fuel vapors replenished into said engine.

18. A fuel system as defined in claim 17, wherein said fuel control means calculates an amount of purging air based on a difference in pressure between before and after said purse valve and an opening of said purge valve and calculates said drawn rate of fuel vapors based on said amount of fuel vapors stored in said evaporation control means and said amount of purging air.

19. A fuel system as defined in claim 18, wherein said fuel control means includes an speed sensor for detecting a speed of rotation of said engine, specifies a hydrodynamic delay characteristic of said evaporation control means between said evaporation control means with respect to fuel vapors and said engine and calculates said rate of fuel vapors replenished into said engine based on an engine speed detected by said speed sensor, said hydrodynamic delay characteristic and said drawn rate of fuel vapors.

20. A fuel system as defined in claim 19, wherein said fuel control means calculates a drawn ratio of fuel vapors drawn from said evaporation control means to a total amount of fuel no be delivered to said engine based on said drawn rate of fuel vapors and said engine speed and calculates a replenishing ratio of fuel vapors replenishing into said engine the said total amount of fuel based on said drawn rate and said hydrodynamic delay characteristic.

21. A fuel system as defined in claim 20, wherein said fuel control means calculates by predetermined equations said amount of purging air, said drawn rate and said hydrodynamic delay characteristic, said drawn ratio and said replenishing ratio, respectively.

22. A fuel system for controlling the amount of fuel delivered into an engine having an intake system comprising:

fuel vapor storage means for storing fuel vapors from a fuel tank;

fuel vapor purging means disposed between said fuel vapor storage means and said intake system and having a purse valve for purging fuel vapor into said intake system from said fuel vapor storage means; and fuel control means for detecting an amount of fuel vapor stored in said fuel vapor storage means and calculating a purging rate of fuel vapors into said intake system from said fuel vapor storage means based on said detected amount of fuel vapors, whereby causing said fuel system to control an amount of fuel to be delivered into said engine based on said calculated amount of fuel vapors.

23. A fuel system as defined in claim 22, wherein said fuel control means calculates a rate of fuel vapors drawn from said fuel vapor storage means toward said intake system and calculates a rate of fuel vapors replenished into said engine.

24. A fuel system as defined in claim 23, wherein said fuel control means calculates an amount of purging air based on a difference in pressure between before and after said purge valve and an opening of said purge valve and calculates said drawn rate of fuel vapors based on said amount of fuel vapors stored in said fuel vapor storage means and said amount of purging air.

25. A fuel system as defined in claim 24, wherein said fuel control means includes an speed sensor for detecting a speed of rotation of said engine, specifies a hydrodynamic delay characteristic of said fuel vapor storage means between said fuel vapor storage with respect to fuel vapors and said engine and calculates said rate of fuel vapors replenished into said engine based on an engine speed detected by said speed sensor, said hydrodynamic delay characteristic and said drawn rate of fuel vapors.

26. A fuel system as defined in claim 25, wherein said fuel control means calculates a drawn ratio of fuel vapors drawn from said fuel vapor storage means to a total amount of fuel to be necessarily delivered to said engine based on said drawn rate of fuel vapors and said engine speed and calculates a replenishing ratio of fuel vapors replenishing into said engine the said total amount of fuel based on said drawn rate and said hydrodynamic delay characteristic.

27. A fuel system as defined in claim 26, wherein said fuel control means calculates by predetermined equations said amount of purging air, said drawn rate and said hydrodynamic delay characteristic, said drawn ratio and said replenishing ratio, respectively.

28. A fuel system as defined in claim 22, wherein said fuel control means restricts purging of fuel vapors to said intake system before completion of detecting said amount of fuel vapor stored in said fuel storage means.

29. A fuel system as defined in claim 22, wherein said fuel control means suspends purging of fuel vapors to said intake system before completion of detecting said amount of fuel vapor stored in said fuel storage means.

30. A fuel system as defined in claim 28, wherein said fuel control means suspends purging of fuel vapors to said intake system before completion of detecting said amount of fuel vapor stored in said fuel storage means during idling.

31. A fuel system as defined in claim 28, wherein said fuel control means lowers a purge rate at which fuel vapors are purged from said fuel storage means before completion of detecting said amount of fuel vapor stored in said fuel storage means.

32. A fuel system as defined in claim 28, wherein said fuel control means decreases an amount of fuel vapors purged from said fuel storage means before completion of detecting said amount of fuel vapor stored in said evaporation control means.

33. A fuel system as defined in claim 30, wherein said fuel control means decreases an amount of fuel vapors purged from said fuel storage means before completion of detecting said amount of fuel vapor stored in said evaporation control means.

34. A fuel system as defined in claim 31, wherein said fuel control means increases gradually said purge rate until said purge rate reaches a target rate when said purse valve changes from a closed position to an open position.

35. A fuel system as defined in claim 22, wherein said fuel control means causes said fuel system to deliver an amount of fuel which is decreased by an amount corresponding to said replenishing ratio from said total amount of fuel.

* * * * *